US012565990B2

(12) United States Patent
D'Agostini

(10) Patent No.: US 12,565,990 B2
(45) Date of Patent: Mar. 3, 2026

(54) BURNER, SYSTEM, AND METHOD FOR HYDROGEN-ENHANCED PULVERIZED COAL IGNITION

(71) Applicant: Air Products and Chemicals, Inc., Allentown, PA (US)

(72) Inventor: Mark Daniel D'Agostini, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 755 days.

(21) Appl. No.: 17/863,228

(22) Filed: Jul. 12, 2022

(65) Prior Publication Data

US 2024/0019118 A1 Jan. 18, 2024

(51) Int. Cl.
*F23C 9/00* (2006.01)
*F23D 1/00* (2006.01)

(52) U.S. Cl.
CPC ..... *F23C 9/003* (2013.01); *F23D 1/00* (2013.01); *F23C 2900/9901* (2013.01); *F23D 2201/20* (2013.01)

(58) Field of Classification Search
None
See application file for complete search history.

(56) References Cited

U.S. PATENT DOCUMENTS 4,495,874 A 1/1985 Greskovich et al.
6,968,791 B2 11/2005 D'Agostini et al.
7,717,701 B2 5/2010 D'Agostini et al.
8,578,892 B2 11/2013 D'Agostini et al.
8,636,500 B2 1/2014 Kloosterman et al.
8,689,710 B2 4/2014 Slavejkov et al.
(Continued)

FOREIGN PATENT DOCUMENTS

CN 103013574 A * 4/2013
EP 0763692 3/1997
EP 3333481 6/2018
KR 100973414 B1 * 7/2010

OTHER PUBLICATIONS

P. Bukowski, et al, "Use of cavity plasmatron in pulverized coal muffle burner for start-up of boiler", Rynek Energii, 2010, 132-136.
(Continued)

*Primary Examiner* — Jason Lau
(74) *Attorney, Agent, or Firm* — Jason M. Ploeger

(57) ABSTRACT

A burner including a first pulverized coal entrained fluid flow conduit; an inner hydrogen conduit; and a hydrogen oxidant conduit positioned between the first pulverized coal entrained fluid flow conduit and the inner hydrogen conduit; an outlet of the inner hydrogen conduit positioned a first distance from an outlet of the hydrogen oxidant conduit such that hydrogen output from the outlet of the inner hydrogen conduit passes through a portion of the hydrogen oxidant conduit to the outlet of the hydrogen oxidant conduit; and the outlet of the hydrogen oxidant conduit being a second distance from an outlet of the first pulverized coal entrained fluid flow conduit such that the hydrogen and the hydrogen oxidant output from the outlet of the hydrogen oxidant conduit passes through a portion of the first pulverized coal entrained fluid flow conduit for being output from the burner.

17 Claims, 21 Drawing Sheets

(56) References Cited

U.S. PATENT DOCUMENTS

| | | | | |
|---|---|---|---|---|
| 9,243,799 | B2 | 1/2016 | D'Agostini et al. | |
| 9,709,269 | B2 | 7/2017 | D'Agostini | |
| 2010/0077944 | A1 | 4/2010 | Slavejkov et al. | |
| 2010/0077945 | A1 | 4/2010 | Hendershot et al. | |
| 2013/0112120 | A1* | 5/2013 | Li | F23D 1/005 110/264 |
| 2019/0271465 | A1 | 9/2019 | Ozawa et al. | |
| 2021/0140634 | A1* | 5/2021 | Zhang | F23D 17/005 |

OTHER PUBLICATIONS

V.E. Messerle, et al, "Plasma Technology for Enhancement of Pulverized Coal Ignition and Combustion", https://www.researchgate.net/publication/266891619.

S. Bhowmik, et al, "An Innovative Approach of Pulverized Coal Combustion by Plasma Technology in India", International Journal of Engineering and Techniques, May-Jun. 2018, 348-351.

G. Sun, et al, "Experimental investigation on a 600 MWe supercritical boiler with the technology of less-oil ignition", 2011 IEEE PES Asia-Pacific Power and Energy Engineering Conference (APPEEC).

Z. Ke, et al, "Plasma ignition system for oil free power plant Zetes in Turkey and its advantages for the changed circumstance of energy market", VGB PowerTech, 2017, 77-81.

"Plasma Ignition System* Flame Stabilization and Cold Start", GE Power, 2018, 1-2.

A.S. Askarova, et al, "Plasma-Supported Coal Combustion in Boiler Furnace", IEEE Transactions on Plasma Science, Dec. 2007, 1607-1616.

* cited by examiner

| Test Pt # | Furnace Wall Temp (°F) | Comb Air Temp (°F) | Coal Firing Rate (MMBtu/hr) | H2 Oxidizer O2 Flow Rate (% of combustion oxidizer) | O2 Concentration in H2 Oxidizer (vol%) | Flame Condition |
|---|---|---|---|---|---|---|
| 1 | 920 | 411 | 3.0 | 7.5% | 40% | Stable / Attached |
| 2 | 920 | 411 | 3.0 | 7.5% | 33% | Stability Limit |
| 3 | 948 | 434 | 3.0 | 7.5% | 25% | Liftoff |
| 4 | 948 | 434 | 3.0 | 7.5% | 20.9% | Blowoff |

FIG. 21

BURNER, SYSTEM, AND METHOD FOR HYDROGEN-ENHANCED PULVERIZED COAL IGNITION

FIELD

The present innovation relates to boilers, combustors, burners for use in such devices, operation of such devices, and operation of burners used in conjunction with such devices.

BACKGROUND

Boilers and other types of combustors can include a combustion chamber in which pulverized coal is combusted. Examples of such devices and systems that can utilize such devices can be appreciated from U.S. Patent Application Publication No. 2010/0007794 and U.S. Pat. Nos. 4,495,874, 6,968,791, 7,717,701, 8,578,892, 8,636,500, 8,689,710, 9,243,799, and 9,709,269.

Traditionally, in pulverized coal boilers, diesel, propane, or natural gas is used for ignition for combustion start-up. Such fuel sources help initiate combustion as these fuels can be more easily ignited than pulverized coal.

In some situations, a plasma ignition system can be used for pulverized coal boilers. The plasma ignition systems are often designed to generate a high energy plasma from a plasma torch at a burner to initiate fuel ignition and generation of a flame. The plasma torch often uses high voltage electricity as its energy source.

SUMMARY

I determined that pulverized coal fired boilers have historically utilized a light fuel oil for cold boiler light-off and heat up. However, this approach results in undesired particulate and carbon monoxide (CO) emissions and has relatively high operating costs. Plasma torches have also been used in such boilers, but have a high capital cost, require frequent maintenance, require water cooling, and have limited operational flexibility. Embodiments of my boiler, combustor, burner, processes for operating burners, and processes for operating boilers and/or combustors can provide significant improvements over these approaches by reducing maintenance and capital costs, as well as operational costs while also promoting a more environmentally friendly combustion of fuel that can at least reduce the particulates included within emissions. In some implementations, the NOx emissions can be reduced while CO formation is also reduced in addition to providing reduced particulates within the emissions. Embodiments can be configured to leverage enhanced combustion kinetics to provide improved performance as well as providing a more environmentally friendly operation of a boiler.

For example, embodiments can provide a significant reduction in particulate matter as the utilization of hydrogen as a secondary fuel can avoid formation of particulates as compared to use of diesel or fuel oil. Also, the ability to avoid use of diesel or fuel oil can avoid use of on-site storage for tanks of this fuel, which can further avoid environmental concerns related to the storage of the fuel and avoid accidental leaks of such fuel from occurring.

Moreover, I determined that embodiments could allow for improved operations and provide improved ease of use and maintenance while keeping capital and operational costs lower. For instance, most large power plants that may use one or more pulverized coal burners have hydrogen storage onsite already for use as a turbine-generator cooling medium. Embodiments can be adapted to utilize this on-site hydrogen for use of the hydrogen as a fuel for the boilers as well. Moreover, embodiments can utilize lower cost burners that possess turndown ratios that can be equal to or greater than 10:1, can require minimal maintenance, and provide improved durability. Such advantages can provide a significant improvement over conventional burner technology that also provides a significant improvement in environmentally friendly operation of the boiler, combustor and/or burner(s) of such embodiments.

In a first aspect, a burner for a combustion chamber is provided. Embodiments of the burner can include a first pulverized coal entrained fluid flow conduit, an inner hydrogen conduit; and a hydrogen oxidant conduit positioned between the first pulverized coal entrained fluid flow conduit and the inner hydrogen conduit. An outlet of the inner hydrogen conduit can be positioned a first distance from an outlet of the hydrogen oxidant conduit such that hydrogen output from the outlet of the inner hydrogen conduit passes through a portion of the hydrogen oxidant conduit to the outlet of the hydrogen oxidant conduit. The outlet of the hydrogen oxidant conduit can be a second distance from an outlet of the first pulverized coal entrained fluid flow conduit such that the hydrogen and the hydrogen oxidant output from the outlet of the hydrogen oxidant conduit passes through a portion of the first pulverized coal entrained fluid flow conduit for being output from the burner.

In a second aspect, the first pulverized coal entrained fluid flow conduit can include an annular conduit for a flow of pulverized coal entrained in a fluid (e.g., air, oxygen enriched air, a mixture of air and hydrogen, a mixture of oxygen enriched air and hydrogen, etc.) and the hydrogen oxidant conduit can include an annular conduit for the flow of a hydrogen oxidant (e.g., air, oxygen enriched air, other type of oxidant flow that includes a concentration of oxygen within a pre-selected oxygen concentration range, etc.). The inner hydrogen conduit can have a circular or oval cross-sectional shape having a single, central passageway for a flow of hydrogen in such embodiments or have another type of cross-sectional shape for such embodiments.

In a third aspect, a secondary oxidant conduit can be positioned adjacent an outer periphery of the first pulverized coal entrained fluid flow conduit to pass a flow of secondary oxidant through the burner and into the combustion chamber. At least one swirler can be positioned in the secondary oxidant conduit so the flow of secondary oxidant swirls within the combustion chamber. The secondary oxidant can be secondary air, oxygen enriched air, or other type of oxidant flow that includes a concentration of oxygen within a pre-selected oxygen concentration range.

In a fourth aspect, a second pulverized coal entrained fluid flow conduit can be positioned adjacent an outer periphery of the first pulverized coal entrained fluid flow conduit such that the first pulverized coal entrained fluid flow conduit is between the second pulverized coal entrained fluid flow conduit and the hydrogen oxidant conduit. A secondary oxidant conduit t can be positioned adjacent an outer periphery of the second pulverized coal entrained fluid flow conduit to pass a flow of secondary oxidant through the burner and into the combustion chamber.

In a fifth aspect, a mixing conduit can be positioned in the portion of the first pulverized coal entrained fluid flow conduit through which the hydrogen and the hydrogen oxidant output from the outlet of the hydrogen oxidant conduit passes for being output from the burner (e.g., the hydrogen and hydrogen oxidant can pass through the mixing conduit before being output from the burner). In such embodiments, a splitter can be optionally provided. The splitter can be positioned to encircle an outer peripheral portion of an outlet region of the hydrogen oxidant flow conduit in the first pulverized coal entrained fluid flow conduit to split the first pulverized coal entrained fluid flow into a first inner flow portion that includes coal particulates therein so that the first portion is directed to the inlet of the mixing conduit to pass through the mixing conduit and a second outer flow portion that passes along an outer side of the mixing conduit. The splitter can be attached to the mixing conduit to be integral to the mixing conduit or can be otherwise fastened, welded, or joined to the mixing conduit. In some embodiments, the splitter can be positioned within the first pulverized coal entrained fluid flow conduit at a location so that it is between the first pulverized coal entrained fluid flow conduit and the hydrogen oxidant conduit adjacent to the outlet of the hydrogen oxidant conduit to divert the first inner flow portion along a passageway defined between the splitter and the hydrogen oxidant conduit for mixing pulverized coal of the first inner portion with the hydrogen and the hydrogen oxidant output from the outlet of the hydrogen oxidant conduit within the mixing conduit.

In a sixth aspect, an outlet of the hydrogen oxidant conduit can be a tapered outlet having a tapered portion and there can be a gap defined between the outlet of the hydrogen oxidant conduit and the mixing conduit such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit.

In a seventh aspect, the outlet of the hydrogen oxidant conduit can be an enlarged outlet having an enlarged portion and there can be a gap defined between the outlet of the hydrogen oxidant conduit and the mixing conduit such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit. This arrangement can result in an outermost portion of the enlarged outlet portion of the outlet of the hydrogen oxidant conduit extending beyond the inlet of the mixing conduit. This can result in the enlarged outlet portion projecting into the first pulverized coal entrained fluid flow conduit and can affect how the flow of a portion of the pulverized coal entrained in fluid is passed into an inlet of the mixing conduit and toward the outlet of the first pulverized coal entrained fluid flow conduit. In some embodiments, the gap can be sized and configured so that a first sized coal particulates are within the first portion of the pulverized coal that is passed through the gap while second sized coal particulates that are larger than the first sized coal particulates are not passed through the gap and pass along the outer side of the mixing conduit as they are passed through the first pulverized coal entrained fluid flow conduit to the outlet of the conduit for being output from the burner.

In an eight aspect, the first pulverized coal entrained fluid flow conduit can be positioned to receive a flow of pulverized coal entrained within a fluid that comprises hydrogen. The hydrogen can be injected into a flow of pulverized coal entrained within a fluid (e.g., air, oxygen enriched air, other fluid) before the flow is fed to the first pulverized coal entrained fluid flow conduit. A control valve can be provided to help control an amount of hydrogen that is injected. The control valve can be adjustable from a closed position that can stop hydrogen injection and at least one open position for providing hydrogen injection at one or more rates of hydrogen injection.

In a ninth aspect, a splitter can be positioned between the first pulverized coal entrained fluid flow conduit and the hydrogen oxidant conduit adjacent to the outlet of the hydrogen oxidant conduit to divert a portion of the pulverized coal along a passageway defined between the splitter and the hydrogen oxidant conduit for mixing the portion of the pulverized coal with the hydrogen and the hydrogen oxidant output from the outlet of the hydrogen oxidant conduit within a mixing conduit. The mixing conduit can be provided downstream of the outlet for the inner hydrogen conduit and/or the outlet for the hydrogen oxidant conduit in some embodiments. In a tenth aspect, a boiler is provided. The boiler can utilize at least one burner that includes the first aspect as well as one or more of the second through ninth aspects discussed above. For instance, the boiler can include at least one burner positioned to generate at least one flame within a combustion chamber. The at least one burner can include a first burner that includes a first pulverized coal entrained fluid flow conduit, an inner hydrogen conduit, and a hydrogen oxidant conduit positioned between the first pulverized coal entrained fluid flow conduit and the inner hydrogen conduit. An outlet of the inner hydrogen conduit can be positioned a first distance from an outlet of the hydrogen oxidant conduit such that hydrogen output from the outlet of the inner hydrogen conduit passes through a portion of the hydrogen oxidant conduit to the outlet of the hydrogen oxidant conduit. The outlet of the hydrogen oxidant conduit can be a second distance from an outlet of the first pulverized coal entrained fluid flow conduit such that the hydrogen and the hydrogen oxidant output from the outlet of the hydrogen oxidant conduit passes through a portion of the first pulverized coal entrained fluid flow conduit for being output from the burner.

In an eleventh aspect, the boiler also includes a source of pulverized coal connected to an inlet of the first pulverized coal entrained fluid flow conduit, a source of hydrogen connected to an inlet of the inner hydrogen conduit, and a source of a flow of an oxidant connected to an inlet of the hydrogen oxidant conduit. The source of hydrogen can include a vessel that includes hydrogen or a process unit that outputs a flow of hydrogen. A source of pulverized coal can include, for example, a vessel retaining pulverized coal or a pulverization unit that outputs pulverized coal. A source of a flow of an oxidant can include air, a process unit that outputs oxygen enriched air or a fluid that includes a concentration of oxygen within a pre-selected oxygen concentration range (e.g., a compressor or other type of process unit), or other source of oxygen.

In a twelfth aspect, the boiler includes a secondary oxidant conduit positioned adjacent an outer periphery of the first pulverized coal entrained fluid flow conduit to pass a flow of secondary oxidant through the burner and into the combustion chamber. The secondary oxidant can be provided by a source of oxidant (e.g., air, a source of secondary air, an air compressor, a process unit that outputs an oxidant flow, etc.).

In a thirteenth aspect, a second pulverized coal entrained fluid flow conduit can be positioned adjacent an outer periphery of the first pulverized coal entrained fluid flow conduit such that the first pulverized coal entrained fluid flow conduit is between the second pulverized coal entrained fluid flow conduit and the hydrogen oxidant conduit. A secondary oxidant conduit can be positioned adjacent an outer periphery of the second pulverized coal entrained fluid flow conduit to pass a flow of secondary oxidant through the burner and into the combustion chamber. The secondary oxidant can be provided by a source of oxidant (e.g., air, a source of secondary air, etc.). A source of pulverized coal connected to an inlet of the second pulverized coal entrained fluid flow conduit. This source can be the same source as used to feed pulverized coal to the first pulverized coal entrained fluid flow conduit or a second, separate source of pulverized coal.

In a fourteenth aspect, the boiler can include a mixing conduit positioned in the portion of the first pulverized coal entrained fluid flow conduit through which the hydrogen and the hydrogen oxidant output from the outlet of the hydrogen oxidant conduit passes for being output from the burner (e.g., the hydrogen and hydrogen oxidant can pass through the mixing conduit before being output from the burner). In such embodiments, a splitter can be optionally provided. The splitter can be positioned to encircle an outer peripheral portion of an outlet region of the hydrogen oxidant flow conduit in the first pulverized coal entrained fluid flow conduit to split the first pulverized coal entrained fluid flow into a first inner flow portion that is directed to the inlet of the mixing conduit to pass through the mixing conduit and a second outer flow portion that passes along an outer side of the mixing conduit. The splitter can be attached to the mixing conduit to be integral to the mixing conduit or can be otherwise fastened, welded, or joined to the mixing conduit. In some embodiments, the splitter can be positioned between the first pulverized coal entrained fluid flow conduit and the hydrogen oxidant conduit adjacent to the outlet of the hydrogen oxidant conduit to divert the first inner flow portion along a passageway defined between the splitter and the hydrogen oxidant conduit for mixing pulverized coal of the first inner portion with the hydrogen and the hydrogen oxidant output from the outlet of the hydrogen oxidant conduit within the mixing conduit.

In a fifteenth aspect, the boiler can be configured so that the outlet of the hydrogen oxidant conduit is a tapered outlet having a tapered portion and there can be a gap defined between the outlet of the hydrogen oxidant conduit and the mixing conduit such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit.

In a sixteenth aspect. the boiler can be arranged so that the outlet of the hydrogen oxidant conduit is an enlarged outlet having an enlarged portion. In such embodiments, the outlet of the hydrogen oxidant conduit can be an enlarged outlet having an enlarged portion (e.g., the outlet of the hydrogen oxidant conduit can widen from a widening location to the distal end of the hydrogen oxidant outlet so the outlet is wider at the distal end than at the widening location upstream of the distal end of the outlet). A gap can be defined between the outlet of the hydrogen oxidant conduit and the mixing conduit such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit. This arrangement can result in an outermost portion of the enlarged outlet portion of the outlet of the hydrogen oxidant conduit extending beyond the inlet of the mixing conduit. This can result in the enlarged outlet portion projecting into the first pulverized coal entrained fluid flow conduit and can affect how a portion of the flow of pulverized coal entrained in fluid is passed into an inlet of the mixing conduit and toward the outlet of the first pulverized coal entrained fluid flow conduit.

In a seventeenth aspect, a splitter can be positioned between the first pulverized coal entrained fluid flow conduit and the hydrogen oxidant conduit adjacent to the outlet of the hydrogen oxidant conduit to divert a portion of the pulverized coal along a passageway defined between the splitter and the hydrogen oxidant conduit for mixing the portion of the pulverized coal with the hydrogen and the hydrogen oxidant output from the outlet of the hydrogen oxidant conduit within the mixing conduit.

In an eighteenth aspect, the boiler can be arranged so that the first pulverized coal entrained fluid flow conduit is positioned to receive a flow of pulverized coal entrained within a fluid that comprises hydrogen. The hydrogen can be injected into the flow of pulverized coal entrained within the fluid prior to that flow being fed to the first pulverized coal entrained fluid flow conduit. A control valve can be utilized to adjust an injection rate of hydrogen fed into the flow as discussed above as well.

In a nineteenth aspect, a process for generating a flame in a combustion chamber of a combustion device is provided. Embodiments of the process can utilize an aspect of the burner discussed above as well as other aspects of a burner discussed herein, or an aspect of the boiler discussed above as well as other aspects discussed herein. Embodiments of the process can include feeding hydrogen, a hydrogen oxidant flow, and a first pulverized coal entrained in an oxidant flow to a burner such that the hydrogen is passed through an inner hydrogen conduit of the burner, the hydrogen oxidant flow is passed through a hydrogen oxidant conduit of the burner that is positioned between a first pulverized coal entrained fluid flow conduit and the inner hydrogen conduit, and the first pulverized coal entrained in the oxidant flow is passed through the first pulverized coal entrained fluid flow conduit. The process can also include outputting the hydrogen from an outlet of the inner hydrogen conduit, so the hydrogen passes a first distance as the hydrogen passes from the outlet of the inner hydrogen conduit to an outlet of the hydrogen oxidant conduit such that hydrogen output from the outlet of the inner hydrogen conduit passes through a portion of the hydrogen oxidant conduit to the outlet of the hydrogen oxidant conduit. Embodiments of the process can additionally include outputting the hydrogen and the hydrogen oxidant flow out of the outlet of the hydrogen oxidant conduit so the hydrogen and the hydrogen oxidant flow passes a second distance as the hydrogen passes from the outlet of the hydrogen oxidant conduit to an outlet of the first pulverized coal entrained fluid flow conduit such that the hydrogen and the hydrogen oxidant output from the outlet of the hydrogen oxidant conduit passes through a portion of the first pulverized coal entrained fluid flow conduit for forming a pilot flame to emanate from an outlet of the burner.

In a twentieth aspect, the process can also include splitting a first portion of the first pulverized coal entrained in the oxidant flow from a second portion of the first pulverized coal entrained in the oxidant flow so the first portion of the first pulverized coal entrained in the oxidant flow mixes with the hydrogen and the hydrogen oxidant flow as the hydrogen and the hydrogen oxidant flow pass along the second distance within the burner to form the pilot flame while the second portion of the first pulverized coal entrained in the oxidant flow is passed through the first pulverized coal entrained fluid flow conduit to be output into the combustion chamber. Embodiments of the twentieth aspect may utilize embodiments that include a mixing conduit and/or a splitter as discussed herein, for example.

In a twenty-first aspect, the process can also include injecting hydrogen into the first pulverized coal entrained in the oxidant flow before the first pulverized coal entrained in the oxidant flow is fed to the burner such that the first pulverized coal entrained in the oxidant flow passed through the first pulverized coal entrained fluid flow conduit comprises hydrogen, pulverized coal, and an oxidant.

In a twenty-second aspect, a burner for a combustion chamber is provided that includes a first pulverized coal entrained fluid flow conduit, an inner hydrogen conduit, and a hydrogen oxidant conduit positioned between the first pulverized coal entrained fluid flow conduit and the inner hydrogen conduit. A mixing conduit can be positioned in the first pulverized coal entrained fluid flow conduit so that hydrogen output from an outlet of the inner hydrogen conduit and hydrogen oxidant output from an outlet of the hydrogen oxidant conduit is passable through the mixing conduit to mix with a first portion of a flow of pulverized coal entrained in a fluid passable through the first pulverized coal entrained fluid flow conduit for being output from the burner as a mixture around a flame formed from combustion of the hydrogen, the hydrogen oxidant, and a portion of the pulverized coal within the first portion of the flow of pulverized coal entrained in the fluid. The mixing conduit can be positioned in the first pulverized coal entrained fluid flow conduit such that a second portion of the flow of pulverized coal entrained in the fluid passable through the first pulverized coal entrained fluid flow conduit is separated from the first portion of the flow of pulverized coal entrained in the fluid via the mixing conduit such that the second portion is emitted out of the burner along with the flame and a non-combusted portion of the mixture of the hydrogen, hydrogen oxidant, and first portion of the flow of pulverized coal entrained in the fluid.

In a twenty-third aspect, embodiments of the burner can include a secondary oxidant conduit positioned adjacent an outer periphery of the first pulverized coal entrained fluid flow conduit to pass a flow of secondary oxidant through the burner and into the combustion chamber. The outlet of the inner hydrogen conduit can be positioned an axial distance $X_{H2}$ relative to the outlet of the hydrogen oxidant conduit and the inner hydrogen conduit can have a diameter $D_{H2}$, and there can be a gap having a gap distance between an inlet of the mixing conduit and the outlet of the hydrogen oxidant conduit that separates the inlet of the mixing conduit from the outlet of the hydrogen oxidant conduit, wherein:

$$-1 \leq X_{H2}/D_{H2} \leq 5 \text{and/or} \quad \text{(i)}$$

$$0.05 \leq ((2*dg*r_1)/(r_4^2-r_1^2)) \leq 0.15; \quad \text{(ii)}$$

where dg is the gap distance, $r_1$ is a radius of the inner hydrogen conduit, $r_2$ is a radius of the hydrogen oxidant conduit, $r_3$ is a radius of the first pulverized coal entrained fluid flow conduit and $r_4$ is a radius of the secondary oxidant conduit.

In such embodiments, the outlet of the hydrogen oxidant conduit can be an enlarged outlet having an enlarged portion (e.g., the outlet of the hydrogen oxidant conduit can widen from a widening location to the distal end of the hydrogen oxidant outlet so the outlet is wider at the distal end than at the widening location upstream of the distal end of the outlet). This arrangement can result in an outermost portion of the enlarged outlet portion of the outlet of the hydrogen oxidant conduit extending beyond the inlet of the mixing conduit. This can result in the enlarged outlet portion projecting into the first pulverized coal entrained fluid flow conduit and can affect how a portion of the flow of pulverized coal entrained in fluid is passed into an inlet of the mixing conduit and toward the outlet of the first pulverized coal entrained fluid flow conduit. The gap defined between the outlet of the hydrogen oxidant conduit and the mixing conduit can be configured such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit. The second portion of the pulverized coal entrained fluid flow can include larger particle sized coal as compared to the first portion of the pulverized coal entrained fluid flow that is passed through the gap for being passed into the mixing conduit.

In a twenty-fourth aspect, the axial distance XH2 can be an axial distance between the outlet of the hydrogen oxidant conduit and the inlet of the mixing conduit.

In a twenty-fifth aspect, the axial distance XH2 can be less than 0 such that the outlet of the inner hydrogen conduit is positioned a first distance from an outlet of the hydrogen oxidant conduit so hydrogen output from the outlet of the inner hydrogen conduit passes through a portion of the hydrogen oxidant conduit to the outlet of the hydrogen oxidant conduit.

In a twenty-sixth aspect, the axial distance XH2 can be 0 such that the outlet of the inner hydrogen conduit is coincident with the outlet of the hydrogen oxidant conduit.

In a twenty-seventh aspect, the axial distance XH2 can be greater than 0 such that the outlet of the inner hydrogen conduit is positioned within the mixing conduit.

In a twenty-eight aspect, embodiments of the burner can include a secondary oxidant conduit positioned adjacent an outer periphery of the first pulverized coal entrained fluid flow conduit to pass a flow of secondary oxidant through the burner and into the combustion chamber. The burner can also include a mixing conduit positioned in the portion of the first pulverized coal entrained fluid flow conduit through which the hydrogen and the hydrogen oxidant output from the outlet of the hydrogen oxidant conduit passes for being output from the burner (e.g., the hydrogen and hydrogen oxidant can pass through the mixing conduit before being output from the burner). The outlet of the inner hydrogen conduit can be an axial length LH2 away from the outlet of the hydrogen oxidant conduit. The inner hydrogen conduit can also have a diameter DH2. An inlet of the mixing conduit can be an inlet distance Gc from a tapering location of the outlet of the hydrogen oxidant conduit at which the hydrogen oxidant conduit starts to taper to the outlet of the hydrogen oxidant conduit. Additionally, the burner can be arranged and configured so that:

$$1 \leq L_{H2}/D_{H2} \leq 5 \text{and/or} \quad \text{(i)}$$

$$0.05 \leq ((2*G_c*r_1)/(r_4^2-r_1^2)) \leq 0.15; \quad \text{(ii)}$$

where $r_1$ is a radius of the inner hydrogen conduit, $r_2$ is a radius of the hydrogen oxidant conduit, $r_3$ is a radius of the first pulverized coal entrained fluid flow conduit and $r_4$ is a radius of the secondary oxidant conduit.

The twenty-eight aspects can be utilized in conjunction with above discussed aspects (e.g., the first aspect through the fourth aspect, the tenth through the fourteenth aspect, etc.).

In a twenty-ninth aspect, the inlet distance Gc can be an axial length of a gap between the inlet of the mixing conduit and the tapering location of the hydrogen oxidant conduit.

In a thirtieth aspect, the burner can include a secondary oxidant conduit positioned adjacent an outer periphery of the first pulverized coal entrained fluid flow conduit to pass a flow of secondary oxidant through the burner and into the combustion chamber and also a mixing conduit positioned in the portion of the first pulverized coal entrained fluid flow conduit through which the hydrogen and the hydrogen oxidant output from the outlet of the hydrogen oxidant conduit passes for being output from the burner (e.g., the hydrogen and hydrogen oxidant can pass through the mixing conduit before being output from the burner). An inlet of the mixing conduit can be spaced apart from the outlet of the hydrogen oxidant conduit by a gap having a gap distance. The outlet of the inner hydrogen conduit can be an axial distance XH2 relative to the outlet of the hydrogen oxidant conduit. The inner hydrogen conduit can also have a diameter DH2. The inlet of the mixing conduit can be the gap distance from the outlet of the hydrogen oxidant conduit and wherein:

$$-1 \leq X_{H2}/D_{H2} \leq 5 \text{and/or} \quad \text{(i)}$$

$$0.05 \leq ((2*dg*r_1)/(r_4^2-r_1^2)) \leq 0.15; \quad \text{(ii)}$$

where dg is the gap distance, $r_1$ is a radius of the inner hydrogen conduit, $r_2$ is a radius of the hydrogen oxidant conduit, $r_3$ is a radius of the first pulverized coal entrained fluid flow conduit and $r_4$ is a radius of the secondary oxidant conduit.

In a thirty-first aspect, the gap distance dg can be an axial distance between the outlet of the hydrogen oxidant conduit and the inlet of the mixing conduit.

In a thirty-second aspect, 32. a mixing conduit can be positioned in the portion of the first pulverized coal entrained fluid flow conduit through which the hydrogen and the hydrogen oxidant output from the outlet of the hydrogen oxidant conduit passes for being output from the burner (e.g., the hydrogen and hydrogen oxidant can pass through the mixing conduit before being output from the burner). An inlet of the mixing conduit can be spaced apart from the outlet of the hydrogen oxidant conduit by a gap having a gap distance. A splitter can be positioned to encircle an outer peripheral portion of an outlet region of the hydrogen oxidant flow conduit in the first pulverized coal entrained fluid flow conduit to split the first pulverized coal entrained fluid flow into a first inner flow portion that is directed to the inlet of the mixing conduit to pass through the mixing conduit and a second outer flow portion that passes along an outer side of the mixing conduit. The outlet of the inner hydrogen conduit can be an axial length LH2 away from the outlet of the hydrogen oxidant conduit and the inner hydrogen conduit can also have a diameter DH2. The inlet of the mixing conduit can be the gap distance from the outlet of the hydrogen oxidant conduit. Additionally, the burner can be arranged such that:

$$1 \leq L_{H2}/D_{H2} \leq 5 \text{and} \quad \text{(i)}$$

$$0.05 \leq ((r_6^2-r_5^2)/(r_8^2-r_7^2)) \leq 0.25; \quad \text{(ii)}$$

where $r_5$ is an outer radius of the hydrogen conduit, $r_6$ is an inner radius of the splitter, $r_7$ is an outer radius of the splitter and $r_8$ is an inner radius of the first pulverized coal entrained fluid flow conduit.

In a thirty-third aspect the splitter can be positioned between the first pulverized coal entrained fluid flow conduit and the hydrogen oxidant conduit adjacent to the outlet of the hydrogen oxidant conduit to divert the first inner flow portion along a passageway defined between the splitter and the hydrogen oxidant conduit for mixing pulverized coal of the first inner portion with the hydrogen and the hydrogen oxidant output from the outlet of the hydrogen oxidant conduit within the mixing conduit In a thirty-fourth aspect, a boiler can include at least one burner positioned to generate at least one flame within a combustion chamber. The at least one burner can include a first burner that is configured as the burner of any of the above noted aspects. For instance, the first burner can be the burner of the twenty-second aspect. Other embodiments of the boiler can have a first burner that includes other features of the twenty-second aspect through the thirty-third aspect, can be a burner of the first aspect, or can be a burner that includes the features of the first aspect along with features from one or more of the second through seventeenth aspects.

In some embodiments, the boiler can include a source of pulverized coal connected to an inlet of the first pulverized coal entrained fluid flow conduit, a source of hydrogen connected to an inlet of the inner hydrogen conduit, and a source of a flow of an oxidant connected to an inlet of the hydrogen oxidant conduit. In some embodiments of the boiler, a source of hydrogen positioned for injection of hydrogen into a flow of pulverized coal entrained within a fluid can also be provided such that the first pulverized coal entrained fluid flow conduit is positioned to receive the flow of pulverized coal entrained within the fluid such that the fluid includes an oxidant and the hydrogen from the source of the hydrogen.

It should be appreciated that different embodiments can utilize one or more of the first through thirty-fourth aspects to create yet additional embodiments having different combinations of these aspects for use in an embodiment of a burner, boiler, combustion apparatus, process for operating at least one burner, a process for operating a boiler or a process for operating a combustor.

The above discussed aspects can be configured and arranged such that there is a gap distance dg, a radius r1 that is a radius of the inner hydrogen conduit, a radius r2 that is a radius of the hydrogen oxidant conduit, a radius r3 that is a radius of the first pulverized coal entrained fluid flow conduit and a radius r4 that is a radius of the secondary oxidant conduit. In such configurations, the radius of each conduit can be a distance from which the inner side of an outer wall of the conduit is from a center axis of the hydrogen conduit or a center axis of the burner. The inner side of the outer wall for each conduit can be the side of the outer wall of the conduit along which a portion of the fluid and/or particulate flowing through the conduit may directly contact as it flows through the conduit. The center axis can be a central axis that extends linearly in an axial direction that is perpendicular to the burner plane or substantially perpendicular to the burner plane (e.g., within 5° of being perpendicular or within 7° of being perpendicular, etc.), for example. The first radius r1 can be a linearly measured distance between the center axis and an inner side of an outer wall of the hydrogen conduit. The second radius r2 can be a linearly measured distance between the center axis and an inner side of an outer wall of the hydrogen oxidant conduit. The third radius r3 can be a linearly measured distance between the center axis and an inner side of an outer wall of the first pulverized coal entrained fluid flow conduit. The fourth radius r4 can be a linearly measured distance between the center axis and an inner side of an outer wall of the secondary oxidant conduit. The gap distance dg can be a linearly measured distance between the outlet of the hydrogen oxidant conduit and the inlet f the mixing conduit (e.g., an axial distance between the inlet of the mixing conduit and the outlet of the hydrogen oxidant conduit that spaces apart the hydrogen oxidant conduit's outlet from the mixing conduit's inlet).

Some of the above discussed aspects can be configured and arranged so that there is a radius r5 that is an outer radius of the hydrogen conduit, a radius r6 that is an inner radius of the splitter, a radius r7 that is an outer radius of the splitter and a radius r8 that is an inner radius of the first pulverized coal entrained fluid flow conduit. Each radius r5-r8 can be a distance from which a portion of a conduit or the splitter is from a center axis of the hydrogen conduit or a center axis of the burner. As discussed above, the center axis can be a central axis that extends linearly in an axial direction that is perpendicular to the burner plane or substantially perpendicular to the burner plane (e.g., within 5° of being perpendicular or within 7° of being perpendicular, etc.), for example. In such configurations, radius r5 can be a linearly measured distance that an inner side of an outer wall of the hydrogen oxidant conduit is from the center axis (radius r5 can also be considered a radius of the hydrogen oxidant conduit (similar to radius r2 discussed above). Radius r6 can be a linearly measured distance between the center axis and an inner side of the splitter. Radius r7 can be a linearly measured distance between an outer side of the splitter and the center axis. Radius r8 can be a linearly measured distance between an inner side of an outer wall of the first pulverized coal entrained fluid flow conduit and the center axis.

The (r62-r521)/(r82-r72)) ratio can be considered a ratio of cross-sectional areas Ar. This ratio Ar can be a ratio of the cross-sectional area between the inner and outer coal flow passages separated by the splitter, which can be assumed as equal to the ratio of the first inner flow portion and second outer flow portion for the flow of the first pulverized coal entrained fluid flow formed via the splitter.

An axial distance XH2 and an axial length LH2 are discussed above. The axial distance XH2 can be a linearly extending distance measured along the center axis of the burner or hydrogen conduit between two positions (e.g., outlet of hydrogen conduit and outlet of the hydrogen oxidant conduit). The axial length LH2 can be a linearly extending distance measured along the center axis of the burner or hydrogen conduit between two positions (e.g., outlet of the hydrogen conduit and the outlet hydrogen oxidant conduit).

Other details, objects, and advantages of boilers, combustors, burners, processes for operating burners, processes for operating boilers and/or combustors, and methods of making and using the same will become apparent as the following description of certain exemplary embodiments thereof proceeds.

BRIEF DESCRIPTION OF THE DRAWINGS

Exemplary embodiments of boilers, combustors, burners, processes for operating burners, processes for operating boilers and/or combustors, and methods of making and using the same are shown in the drawings included herewith. It should be understood that like reference characters used in the drawings may identify like components.

FIG. 21 is a table illustrating testing results from testing conducted on an exemplary embodiment of the burner utilizing an exemplary embodiment of the process for generating at least one flame in a combustion chamber 3.

DETAILED DESCRIPTION OF EXEMPLARY EMBODIMENTS

Figure 1:
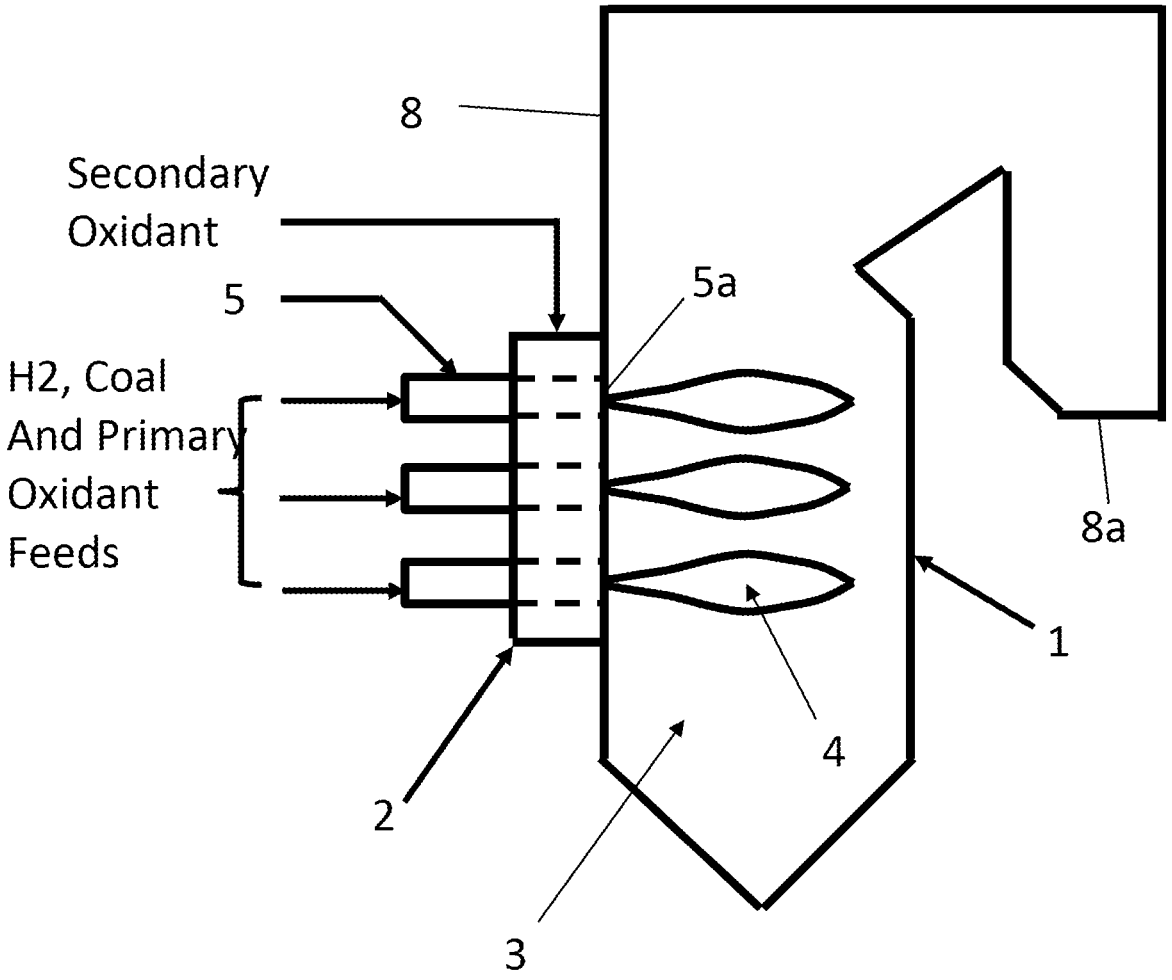
FIG. 1 is a schematic view of a first exemplary embodiment of a boiler 1 having a combustor therein that includes one or more burners 5 configured to output one or more flames 4 into a combustion chamber 3 of the boiler 1.
Figure 2:
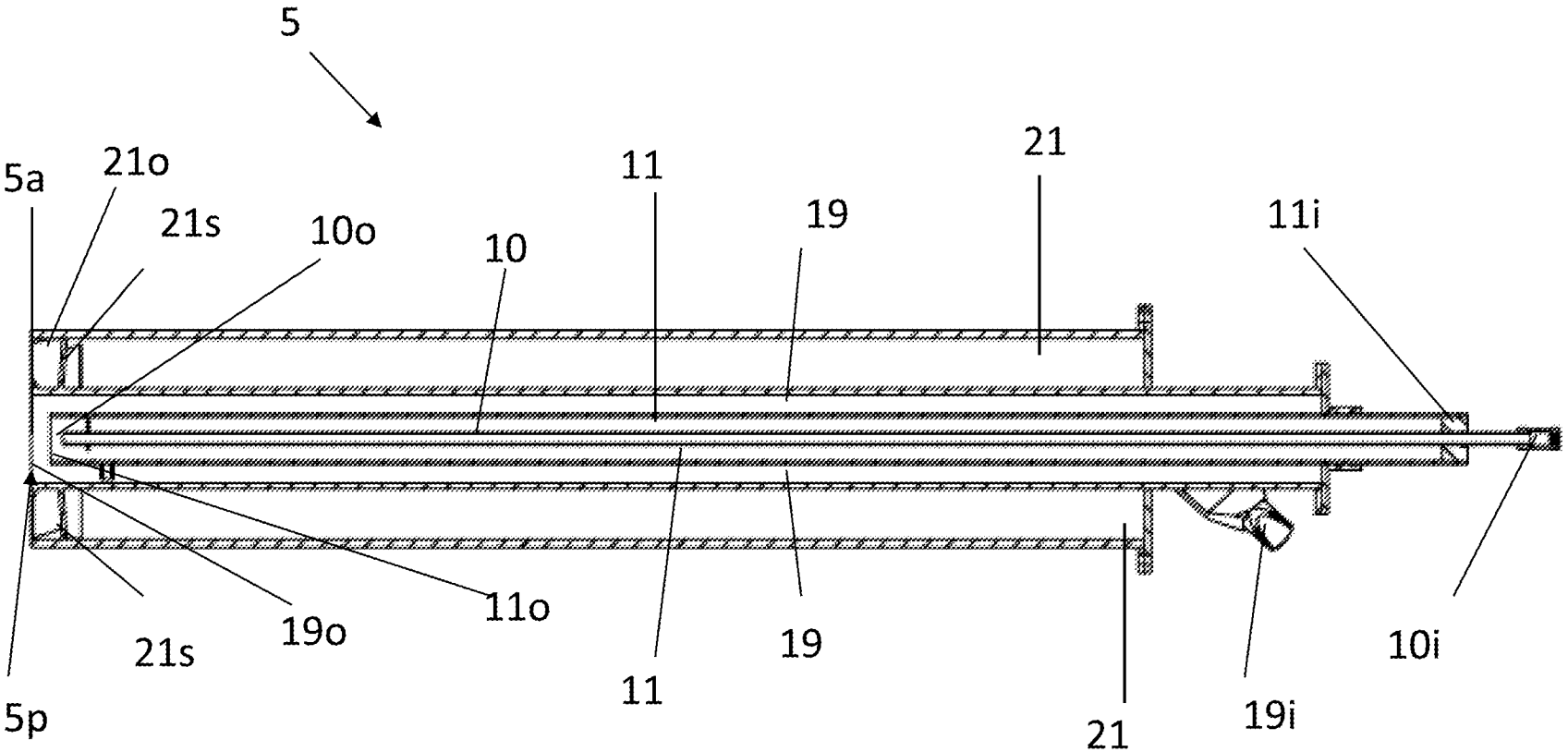
FIG. 2 is a schematic cross-sectional view of a first exemplary embodiment of a burner that can be utilized in the first exemplary embodiment of the boiler.
Figure 3:
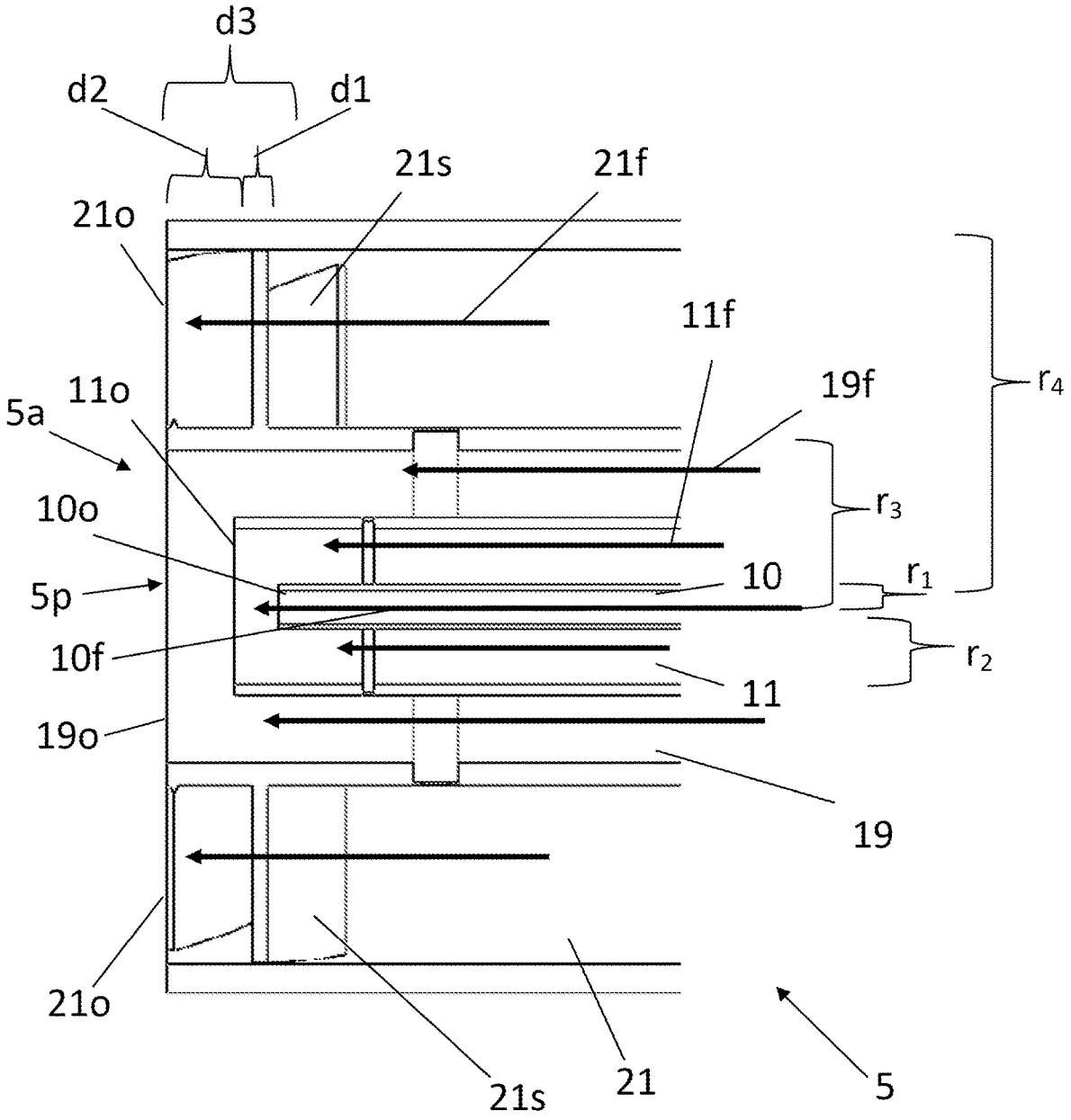
FIG. 3 is schematic fragmentary view of the burner outlet region of the first exemplary embodiment of the burner.
Figure 4:
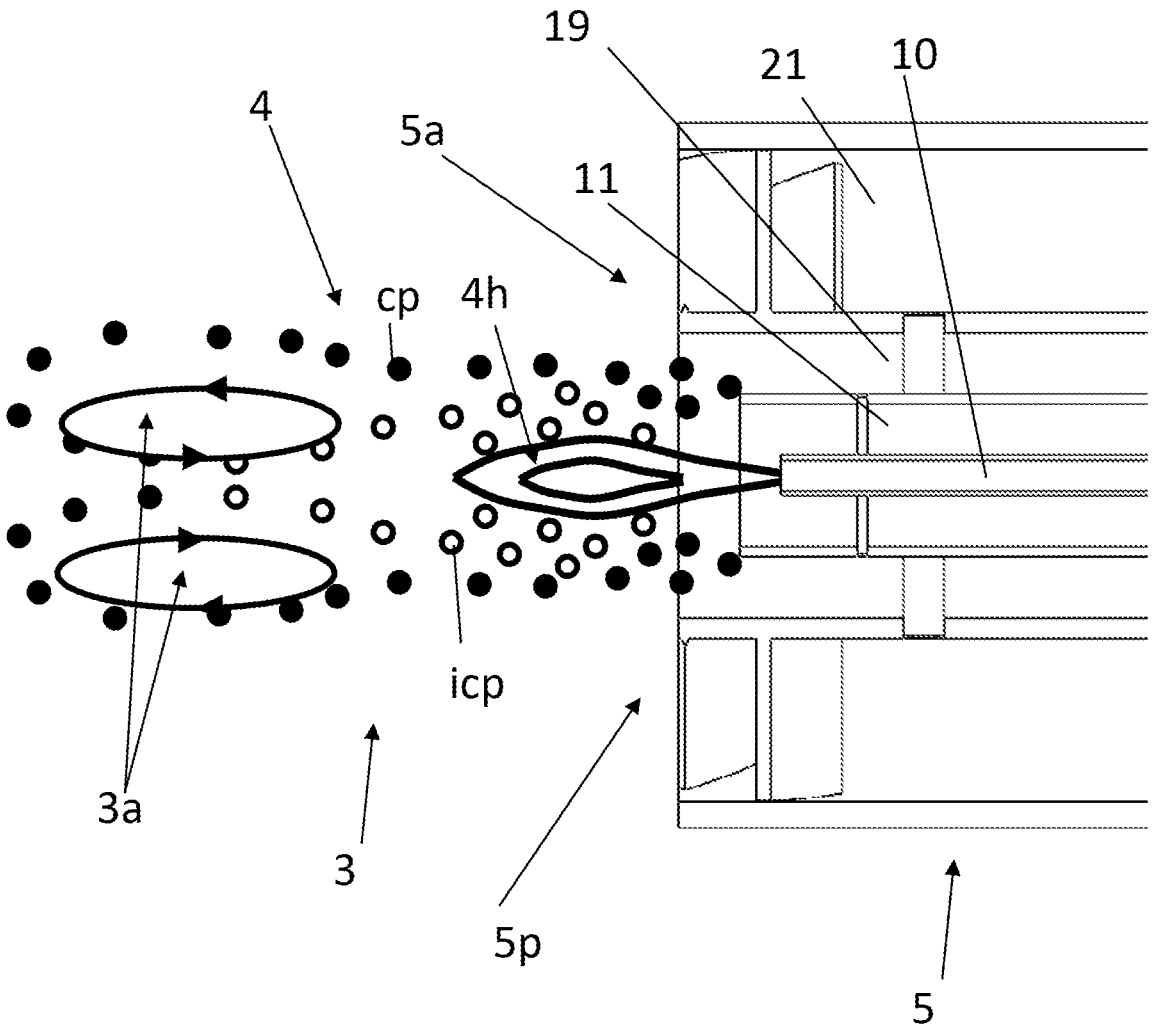
FIG. 4 is a schematic fragmentary view of the burner outlet region of the first exemplary embodiment of the burner generating at least one flame within the combustion chamber 3 of the combustor of the boiler 1.
Figure 5:
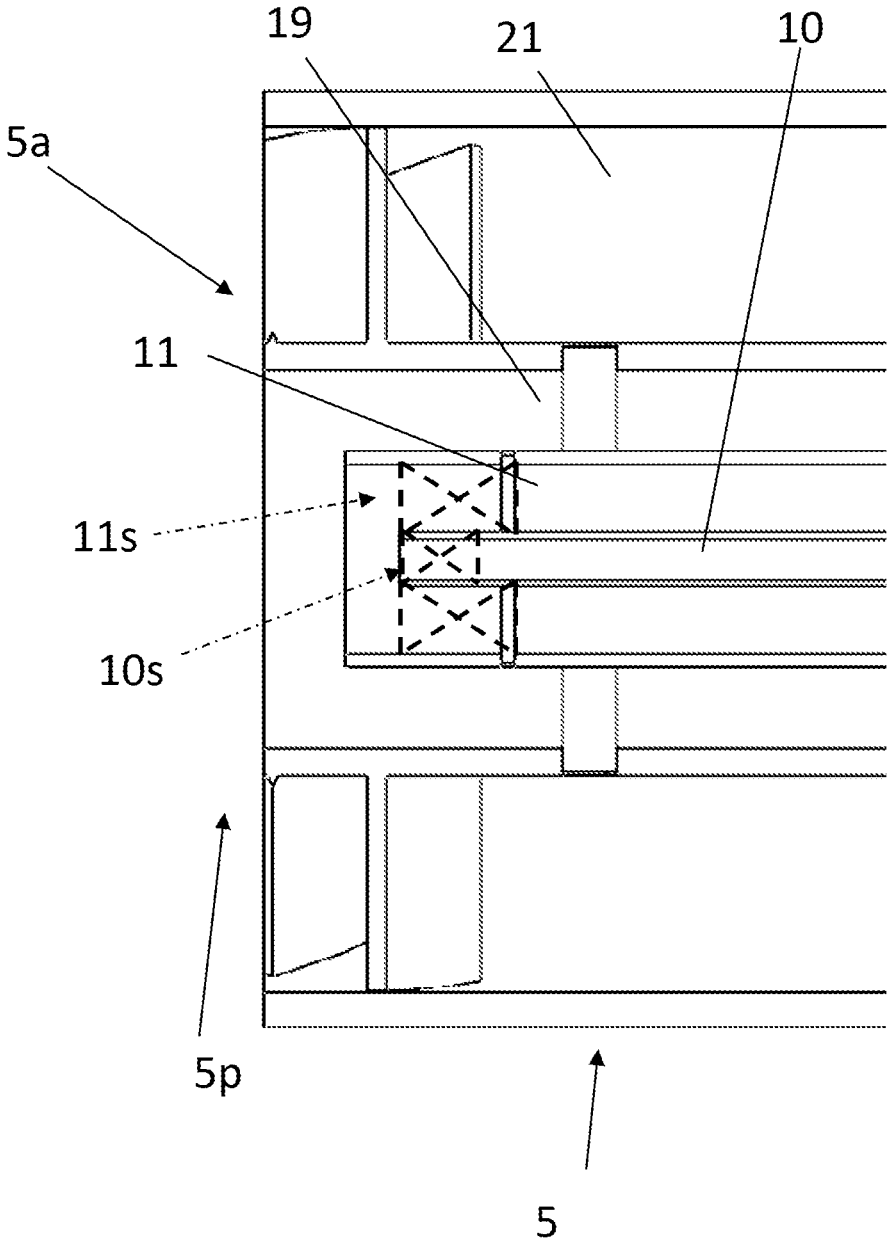
FIG. 5 is schematic fragmentary view of the burner outlet region of the first exemplary embodiment of the burner that is similar to FIG. 3 and illustrates exemplary swirlers shown in broken line that can be included in the burner.

Referring to FIGS. 1-19, a boiler 1 can include a combustor that has a combustion chamber 3. Fuel can be fed into the combustion chamber and burned therein via at least one burner 5 (e.g., a single burner 5, multiple burners 5, etc.). Each burner 5 can be connected to a windbox 2 that can be connected to the boiler 1 or included in the boiler 1. The one or more burners 5 can be connected to the windbox 2 for receipt of secondary air or another type of secondary oxidant flow (e.g., air, oxygen enriched air, other oxygen containing fluid flow) for outputting that secondary oxidant flow with fuel and at least one primary oxidant flow included with the fuel. In some configurations, the windbox 2 can be arranged for providing one or more other oxidant flows to the burners 5 as well. There can also be other sources of oxidant flows that can be connected to the burners 5.

Each burner 5 can be configured to output one or more burner flows from the burner's outlet 5*a* to combust at least one fuel to generate at least one flame 4 within the combustion chamber 3. The generated flame(s) 4 formed in the combustion chamber 3 can cause hot gases that include combustion products to pass out of the combustion chamber and into a flue 8 or other conduit of the boiler 3 for use in heating water to form steam and/or to heat another fluid. The formed steam or other heated fluid can be fed to other process units. For instance, the formed steam can be fed to at least one turbine for power generation and other heated fluid can be utilized in other plant units (e.g., use of hot fluid in a heat exchanger, etc.).

The combustion gases can be output from a boiler output 8*a* as at least one stream of flue gas. The flue gas output from the boiler 1 can be fed to other downstream process units (e.g., a heat exchanger, a wash tower, a filtration unit, a carbon capture unit, etc.) to undergo use of the output fluid in other plant processes and/or treatment of the fluid for emitting an output stream to the atmosphere as an emission stream.

The boiler 1 can utilize a plurality of different burners or a single burner 5. When multiple burners 5 are utilized, an array of burners can be positioned at different locations or can be positioned in an aligned location to meet a particular pre-selected set of design criteria to help promote a desired combustion process or temperature profile within the combustion chamber. Each burner 5 can be an embodiment of a burner discussed herein. In some implementations, all the one or more burners can utilize the same configuration (e.g., be the embodiment of FIGS. 2-6, 7-9, 17-18, or other embodiment discussed herein). In other implementations, the burners 5 can have different configurations (e.g., one or more burners can be an embodiment of FIGS. 2-6, one or more other burners can be an embodiment of FIGS. 7-9, one or more other burners can be an embodiment of FIGS. 10-14, and/or one or more burners can be an embodiment of FIGS. 17-18, etc.).

Each burner 5 can have a burner outlet 5*a*. A flame 4 can be generated and emitted from the outlet 5*a* via a burner plane 5*p* of the burner 5. The burner plane 5*p* can be adjacent a wall of the combustion chamber 3 to which the burner is mounted, for example.

As may best be appreciated from FIGS. 2-18, each burner 5 can have a particular structure to facilitate the feeding of both hydrogen and pulverized coal into the combustion chamber 3 for fuel to be combusted for forming at least one flame 4 and generation of hot gas including combustion products that results from combustion of the fuel and formation of the flame(s) 4. The burner 5 can be configured to utilize at least one flow of hydrogen to help with the ignition of pulverized coal at a startup of the boiler to help with flame generation for forming a flame 4 with improved stability, reduced nitrous oxide (NOx) formation, help minimize particulate formation from the combustion of the fuel, and overall improved performance, for example. The hydrogen can also be utilized after start-up of the boiler while the boiler is operating at a steady-state condition or other non-startup condition to help provide improved flame stability, help keep NOx formation low, reduce particulate and CO2 emissions and provide improved operational performance as well.

For instance, the improved startup of the flame 4 can be performed with a reduction in particulate and CO2 emissions formed during the combustion of fuel process for starting up the combustion of fuel within the combustion chamber 3 for forming one or more flames 4 therein and generating flue gas that includes combustion products. The formed combustion gases can include significantly less particulates as compared to conventional boilers that may use a diesel fuel or oil fuel as a secondary fuel. Embodiments of the burners can be adapted so that hydrogen can also be fed during steady state operation of the boiler via the burner(s) 5 to help provide improved flame stability and a reduction in particulates formed during the combustion process.

The utilization of hydrogen as a secondary fuel for the burner can be configured to provide an extension in turndown operation of the boiler 1 and improve load-following capabilities of the boiler 1. Embodiments can provide a turndown ratio of 10:1 or more, for example. It can also help facilitate improvement in emissions by reducing NOx formation and NOx emissions as well as reducing particulate and CO2 emissions. Further, embodiments can provide highly durable burners that can be fabricated at a relatively low capital cost while also needing little, if any routine maintenance, which can also help improve operational performance of a boiler 1 and/or the burner 5.

Embodiment of the burner 5 can include a burner outlet 5*a* that can emit a flow of hydrogen having a hydrogen (or H2) concentration of at least 30 volume percent (vol %), a primary hydrogen oxidant flow having an oxygen (or O2) concentration greater than or equal to that which normally exists in air (~20.8 vol %) and preferably between approximately 20.8 and 50 vol %, at least one flow of a mixture of pulverized coal (e.g., solid particulates of coal) entrained within a coal transport fluid (e.g., air, nitrogen, air mixed with nitrogen, carbon dioxide, oxygen enhanced air, air mixed with hydrogen gas, oxygen enriched air mixed with hydrogen gas, etc.), wherein the ratio of coal to coal oxidant within the transport fluid is in the range of approximately 0.1 to 10 pounds (lb.) coal per lb. of coal oxidant fluid. At least one flow of a secondary oxidant (e.g., air, oxygen enhanced air, etc.) can also be output from the burner outlet 5*a*.

At the 0.1 lb. of coal per lb. of coal oxidant fluid concentration that can be outputtable from the burner 5, the coal-oxidant can be considered a lean mixture that may be more difficult to ignite. In contrast, the 10 lb. coal per lb. of coal oxidant fluid concentration can be considered a dense mixture that could be more difficult to pneumatically transport with any less dilution.

The secondary oxidant flow 21*f* can be a flow of secondary air (most preferably), an oxygen enriched air flow, or other oxygen containing oxidant flow of gaseous fluid, can be fed into a secondary oxidant conduit 21 for being emitted out of an outlet 210 of the secondary oxidant conduit 21. In some embodiments, this secondary oxidant flow can be an air flow provided by a blower or compressor (not shown) that may compress an air flow for feeding toward the one or more burners 5 and/or to the windbox 2.

There can be one or more swirlers 21*s* positioned in the secondary oxidant conduit 21. Each of the swirlers 21*s* can be a body positioned in or adjacent the conduit so that the secondary oxidant flow 21*f* swirls about or around the burner central axis or longitudinal axis as a result of passing along the body of the swirler 21*s* so the output of the secondary oxidant flow swirls within the combustion chamber 3 after being emitted from the outlet 210 of the secondary oxidant conduit 21 positioned at or adjacent the outlet 5*a* of the burner 5.

The secondary oxidant conduit 21 can be an annular shaped conduit that is positioned to enclose at least one pulverized coal entrained fluid flow conduit (e.g,. a first pulverized coal entrained fluid flow conduit 19). For example, the secondary oxidant conduit 21 can be positioned around an outer periphery of a second pulverized coal entrained fluid flow conduit 29 as shown in the exemplary embodiment of FIGS. 17 and 18. As another example, the secondary oxidant conduit 21 can be positioned around an outer periphery of a first pulverized coal entrained fluid flow conduit 19 as shown in the embodiments of FIGS. 2-16.

A first pulverized coal entrained fluid flow conduit 19 can include an inlet 19*i* at which pulverized coal mixed with air or other transport fluid (e.g., oxygen enriched air, etc.) can be fed into the first pulverized coal entrained fluid flow conduit 19 so a first flow 19*f* of a mixture of pulverized coal and transport fluid (e.g., coal particulates entrained within air, oxygen enriched air, other oxidant fluid flow, etc.) can be passed through the first pulverized coal entrained fluid flow conduit 19 for being emitted at an outlet 5*a* of the burner 5. The first pulverized coal entrained fluid flow conduit 19 can also have an outlet 190 adjacent the outlet 5*a* of the burner through which at least a portion of the first flow 19*f* of a mixture of pulverized coal and transport fluid can be output from the first pulverized coal entrained fluid flow conduit 19. For instance, the outlet 190 can be at the terminal outlet 5*a* for the burner 5. In some embodiments, this first flow of pulverized coal entrained within a gaseous transport fluid passed through the first pulverized coal entrained fluid flow conduit 19 can include hydrogen gas mixed therein as well (see e.g., H2 mixing option shown in FIGS. 6 and 12, for example).

The first pulverized coal entrained fluid flow conduit 19 can be an annular shaped conduit that is positioned to enclose an inner hydrogen conduit 10 and an inner hydrogen oxidant conduit 11. For example, the first pulverized coal entrained fluid flow conduit 19 can be positioned around an outer periphery of the inner hydrogen oxidant conduit 11 as shown in the exemplary embodiments of FIGS. 2-18.

The hydrogen conduit 10 can be positioned within the inner hydrogen oxidant conduit 11 so that the inner hydrogen oxidant conduit 11 is positioned around an outer periphery of the inner hydrogen conduit 10 as shown in the exemplary embodiments of FIGS. 2-18. In such embodiments, the inner hydrogen oxidant conduit 11 can be between the hydrogen conduit 10 and the first pulverized coal entrained fluid flow conduit 19. The hydrogen conduit 10 can be an innermost conduit of the burner 5 or an inner, central conduit of the burner 5.

In embodiments that utilize a second pulverized coal entrained fluid flow conduit 29 (e.g., embodiment of FIGS. 17-18, etc.), the second pulverized coal entrained fluid flow conduit 29 can be positioned between the first pulverized coal entrained fluid flow conduit 19 and the secondary oxidant conduit 21. In embodiments that do not utilize the second pulverized coal entrained fluid flow conduit 29 (e.g., embodiments of FIGS. 1-11), the first pulverized coal entrained fluid flow conduit 19 can be positioned between the inner hydrogen oxidant conduit 11 and the secondary oxidant conduit 21.

The secondary oxidant conduit 21 can be an outermost conduit through which an oxygen containing fluid (e.g., a gaseous airflow, an oxygen enriched gaseous air flow, etc.) is passed through the burner 5 as a secondary oxidant flow 21*f* for being fed into the combustion chamber 3 via the outlet 5*a* of the burner 5. The hydrogen conduit 10 can be the central conduit or innermost conduit through which a hydrogen fluid flow is passed through the burner as a hydrogen flow 10*f* that passes from the inlet 10*i* to the outlet 10*o* of the hydrogen conduit 10 for being fed into the combustion chamber 3 via the outlet 5*a* of the burner 5. The other conduits of the burner 5 can be considered intermediate conduits that are positioned between the hydrogen conduit 10 and the secondary oxidant conduit 21.

The various conduits can have various dimensions and spacing relative to each other. For example, the hydrogen conduit 10 can have a radius r1, and a diameter DH2. The inner hydrogen oxidant conduit 11 can have a radius r2, the first pulverized coal entrained fluid flow conduit 19 can have a radius r3, and the secondary oxidant conduit 21 can have a radius r4. The second pulverized coal entrained fluid flow conduit 29 can also have a radius. The radius of each conduit can be a distance from which the inner side of an outer wall of the conduit is from a center axis 10*ca* of the hydrogen conduit 10 (shown in broken line in FIG. 9, for example). The inner side of the outer wall for each conduit can be the side of the outer wall of the conduit along which a portion of the fluid and/or particulate flowing through the conduit may directly contact as it flows through the conduit. The center axis $\mathbf{10}_{ca}$ can be a central axis of the burner that extends linearly in an axial direction that is perpendicular to the burner plane 5*p* or substantially perpendicular to the burner plane 5*p* (e.g., within 5° of being perpendicular or within 7° of being perpendicular, etc.), for example.

The inner hydrogen oxidant conduit 11 can receive a hydrogen oxidant flow 11*f* at its inlet 11*i* and output that hydrogen oxidant flow 11*f* at its outlet 11*o* such that the hydrogen oxidant flow 11*f* passes through the burner 5 via the inner hydrogen oxidant conduit 11. The hydrogen oxidant flow 11*f* can be received at the inlet 11*f* via the windbox 2 or via a separate hydrogen oxidizer supply that can feed the hydrogen oxidant flow 11*f* to the inner hydrogen oxidant conduit 11. The separate hydrogen oxidizer supply can be a separate blower or compressor, a liquid oxygen supply vessel or a combination of such oxidizer sources fluidly connected to the inlet 11*i* of the hydrogen oxidant conduit 11. This hydrogen oxidant flow 11*f* fed to the inner hydrogen oxidant conduit 11 can be a portion of compressed air received from a compressor, or can be a flow of enriched oxygen air, for example. In some embodiments, at least one swirler 11*f* can be positioned adjacent the outlet 11*o* of the inner hydrogen oxidant conduit 11 so that the oxidant flow passing through the inner hydrogen oxidant conduit is caused to swirl about the burner longitudinal axis by passing along the swirler(s) 11*s* so that the hydrogen oxidant flow 11*f* output from the outlet swirls within the combustion chamber 3. Preferably, the swirling flow of hydrogen oxidant swirls in the same direction as the secondary oxidant output from the secondary oxidant conduit 21.

The hydrogen conduit 10 can receive a flow of hydrogen fluid (e.g., hydrogen gas) at its inlet 10*i* for being output into the combustion chamber 3 via the outlet 10*o* of the hydrogen conduit 10 and outlet 5*a* of the burner such that the hydrogen flow 10*f* passes through the burner via the hydrogen conduit 10. The flow of hydrogen 10*f* can be received from a vessel containing a hydrogen gas or can be received from another plant process element that may output the flow of hydrogen.

The hydrogen conduit 10 and hydrogen oxidant conduit 11 can be positioned so that a pilot flame 4*h* can be formed as the hydrogen and oxidant flows output from the outlets 11*o* and pass into the combustion chamber 3. This pilot flame 4*h* can be generated as an inner flame adjacent the burner outlet 5*a* for facilitating ignition and combustion of the coal output from the first pulverized coal entrained fluid flow conduit 19 and in turn (when present) the second pulverized coal entrained fluid flow conduit 29 to form the flame(s) 4 in the combustion chamber. The formed flame(s) 4 can emanate outwardly from the pilot flame 4*h* within the combustion chamber 3. In some situations, the formed flame can encircle, or enclose, the pilot flame 4*h* in the combustion chamber, for example. The secondary oxidant conduit 21 can output an additional flow of oxidant to help further facilitate combustion of the coal and hydrogen in the combustion chamber and generation of a stable flame 4 and help define a central recirculation zone 3*a* within the combustion chamber 3.

In some embodiments, at least one swirler 10*s* can be positioned adjacent the outlet 10*o* of the inner hydrogen conduit 10 so that the hydrogen flow 10*f* (e.g., flow of hydrogen gas, or H2 gas, flow of gas comprising hydrogen, H2, etc.) passing through the hydrogen conduit 10 is caused to swirl by passing along the swirler(s) 10*s* so that the hydrogen flow 10*f* output from the outlet 10*o* swirls within the combustion chamber 3. It should be appreciated that embodiments of the burner 5 can utilize no swirlers 10*s* and 11*s* in the hydrogen conduit 10 and inner hydrogen oxidant conduit 11, utilize swirlers 10*s* and 11*s* in the hydrogen conduit 10 and the inner hydrogen oxidant conduit 11, or only utilize swirlers 10*s* in the hydrogen conduit 10 or only utilize swirlers 11*s* in the inner hydrogen oxidant conduit 11. The use of these swirlers 10*s*, 11*s* can be utilized in conjunction with swirlers in other conduits (e.g., secondary oxidant conduit 21). The non-use of these swirlers 11*s*, 10*s* can also be utilized in embodiments in which one or more swirlers 21*s* are included in the secondary oxidant conduit 21

The second pulverized coal entrained fluid flow conduit 29, when utilized in some embodiments (e.g., embodiment of FIGS. 17-18), can receive a second flow of pulverized coal entrained within a transport fluid 29*f* at its inlet 29*i* so that this second flow 29*f* of pulverized coal entrained within the gaseous oxidant passes through the burner 5 via the second pulverized coal entrained fluid flow conduit 29 to be output via the outlet 290 of the second pulverized coal entrained fluid flow conduit 29. In some embodiments, this second flow of pulverized coal entrained within the transport fluid 29*f* can include hydrogen gas as well. Examples of the transport fluid for the second flow of pulverized coal entrained within the transport fluid 29*f* can include a gaseous oxidant (e.g., air, oxygen enriched air, oxygen enriched flue gas, etc.) or a non-oxidant containing gas flow (e.g., nitrogen, carbon dioxide, a mixture of nitrogen and carbon dioxide gases, etc.).

As may best be appreciated from FIGS. 2-6, embodiments of the burner 5 can have an outlet 5*a* that is structured so that the hydrogen flow 10*f* output from the hydrogen conduit 10 passes along a first distance d1 to pass from the outlet 10*o* of the hydrogen conduit to reach the outlet 11*o* of the inner hydrogen oxidant conduit 11, which can permit the hydrogen to begin to mix with the oxidant flow output from the hydrogen oxidant conduit 11. After passing the first distance d1, these flows 10*f*, 1 if can pass out of the outlet 11*o* of the hydrogen oxidant conduit 11 and travel a second distance d2 to the outlet 190 of the first pulverized coal entrained fluid flow conduit 19. This second distance d2 can be pre-selected to permit a pre-selected amount of mixing between the hydrogen and hydrogen oxidant flows and the flow of coal entrained with a primary oxidant flow of the first flow 19*f* of a mixture of pulverized coal and transport fluid passing through the first pulverized coal entrained fluid flow conduit 19 toward the outlet 190 of this conduit.

Along this second distance d2, the flows of coal, hydrogen, and oxidant can interface with each other and mix. The presence of swirlers 11*s* and 10*s* can contribute to such mixing that can occur as these flows pass along the first and second distances d1 and d2. As may best be seen from FIG. 4, the pilot flame 4*h* can be formed as a result of the mixing of the hydrogen and hydrogen oxidant flows, which may initiate during the travel of these flows along the first distance d1.

The initiation of the ignition of the pilot flame 4*h* can occur at the exit plane of the inner hydrogen conduit 10 (e.g., at the outlet 10*o*). The first distance d1 can be sized and configured to enable the pilot flame 4*h* to partially develop so it can become hotter and more chemically active prior to contacting a pulverized coal stream, which can initially occur at the exit plane of the inner hydrogen oxidant conduit 11 (e.g., at the outlet 11*o*). The first and second distances d1 and d2 can be defined and structured to avoid being too long so that overheating of conduit walls can be avoided while still facilitating improved flame development.

The pilot flame 4*h* can contribute to heating of solid coal particulates cp within the first flow 19*f* of the mixture of pulverized coal and transport fluid so that some of these particulates are ignited as ignited coal particulates icp to begin formation of a larger flame 4 that can emanate from the pilot flame 4*h*. These flows can mix with the secondary oxidant flow 21*f* output from the outlet 210 of the secondary oxidant conduit 21 as these flows pass through the combustion chamber 3. The generated flame 4 and output of these flows can define a recirculation zone 3*a* within the combustion chamber 3. This recirculation zone 3*a* can facilitate further combustion of the coal particulates cp in the combustion chamber 3 for a stable generation of the flame 4 that is defined by the pilot flame 4*h* and the ignited coal particulates icp that are combusting around the pilot flame 4*h*. Combustion products formed from the combustion of the coal and hydrogen fuels (e.g., carbon dioxide, steam, etc.) can pass out of the combustion chamber toward an outlet of the boiler 1. Other coal particulates that have not yet ignited can circulate within the recirculation zone 3*a* for subsequent combustion as these particulates are exposed to the generated flame 4.

The utilization of swirlers 21*s* can help provide a cascading ignition of the coal in the recirculation zone due to the recirculation flow path that is affected by the secondary oxidant swirling flow output from the secondary oxidant outlet 21*o*. This cascading ignition effect can be further augmented by use of swirlers his and/or 10*s* discussed above by having such swirlers promote swirling of the hydrogen flow 10*f* and/or hydrogen oxidant flow 11*f* output from the burner so that the secondary oxidant flow swirls in the same direction as these other swirling flows in the combustion chamber 3.

The first distance d1 and second distance d2 can be portions of a third distance d3, which can be the distance from the outlet 10*o* of the hydrogen conduit 10 to the distal end of the burner outlet 5*a*. The first distance d1 can be a smaller distance than the second distance d2. In some embodiments, the first and second distances d1 and d2 can be the same distance. In some embodiments, the ratio of the first distance to the second distance (e.g., d1/d2) can be less than 1 and greater than 0.1 or less than 1 and greater than 0.5.

The first and second distances d1 and d2 can also be related to the radiuses associated with the annular gaps of the inner hydrogen oxidant conduit 11 and first pulverized coal conduit 19. For instance, a radius r2 of the inner hydrogen oxidant conduit and the radius r3 of the first pulverized coal conduit can be related to the first and second distances and be used to specific a particular size or length for those distances. For example, the ratios d1/r2 and d2/r3 may be selected so that none of these ratios is above 5 (e.g., d1/r2 is less than or equal to 5 and greater than 0 and d2/r3 is less than or equal to 5 and greater than 0).

As noted above, the first and second distances d1 and d2 can be selected to help facilitate improved pilot flame development. The distances can also help provide a diversion of a smaller portion of coal into the pilot flame 4*h* while a larger portion of the coal is output as non-ignited coal particulates. In some embodiments, the chemical energy of the hydrogen flow used to form the pilot flame 4*h* can be at least ten times greater than the chemical energy of the diverted coal fraction that is mixed into the pilot flame 4*h*. This diversion of the coal fraction can also be provided by use of a splitter 41 and/or mixing conduit 31 as discussed below. Other embodiments may utilize a different diversion of coal particulates to provide a different ratio of chemical energies for the hydrogen and diverted coal fraction utilized to form the pilot flame 4*h*. The diversion of the coal into the pilot flame can augment the pilot flame 4*h* to increase its power to improve the pilot flame's ability to effectively ignite the balance of the coal exiting the burner outlet 5*a* to form the larger flame emanating from the burner within the combustion chamber 3.

Figure 6:
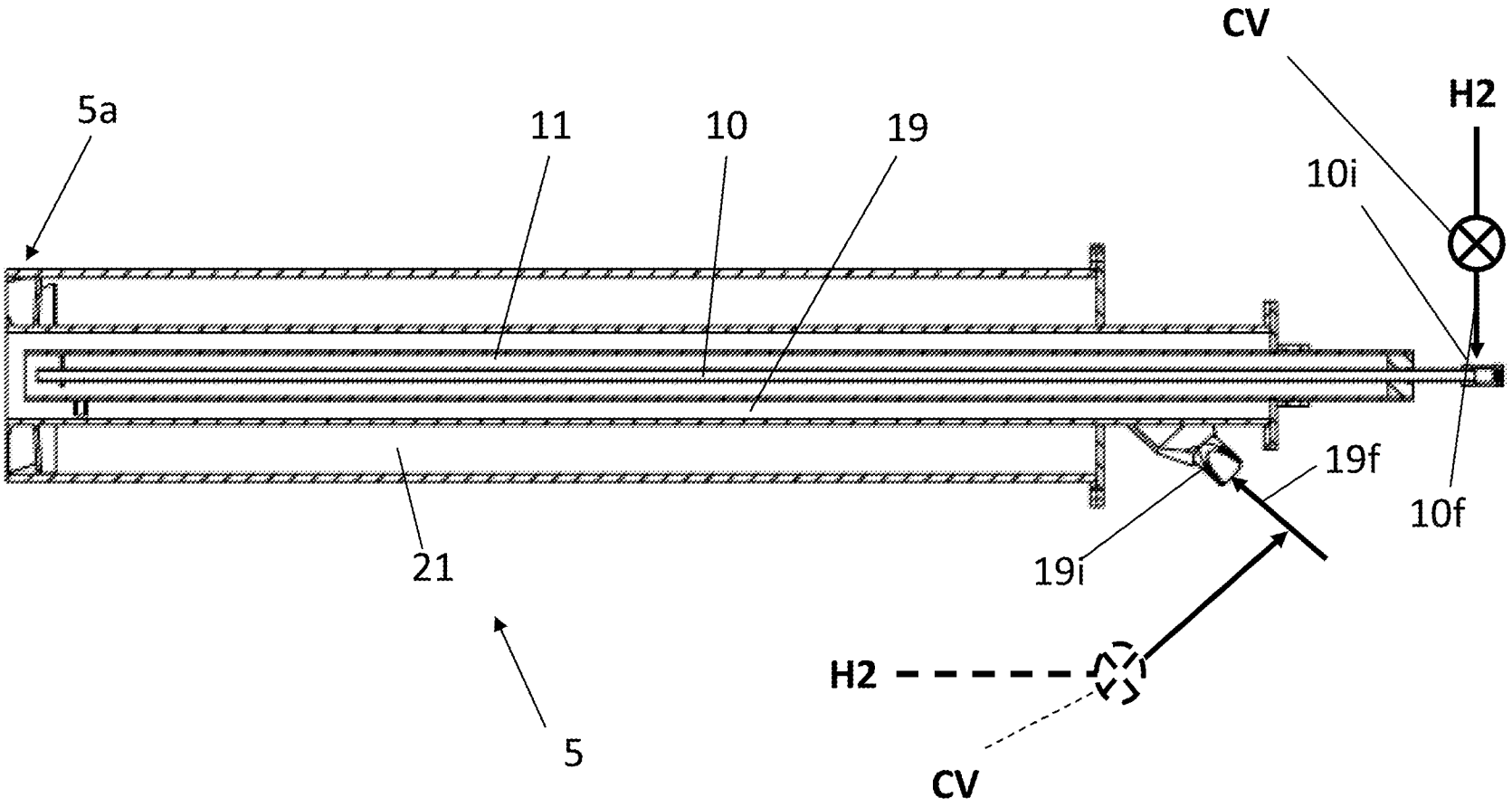
FIG. 6 is a schematic view of the first exemplary embodiment of a burner that can be utilized in the first exemplary embodiment of the boiler similar to FIG. 2 that includes a schematic illustration of feed flows fed to the burner. A hydrogen feed for including hydrogen into a flow of pulverized coal mixed with a primary air flow (e.g., air, a primary oxidant flow for mixing with the solid particulates of the pulverized coal, etc.) is shown in broken line.

As may best be appreciated from FIG. 6, the first flow 19*f* of the mixture of pulverized coal and transport fluid can also include hydrogen mixed therein. For instance, the first flow 19*f* of the mixture of pulverized coal and transport fluid can include hydrogen gas included with air or oxygen enriched air and pulverized coal particulates. A hydrogen feed H2 can be fed to mix with pulverized coal and an oxidant fluid (e.g., gaseous air, gaseous oxygen enriched air, an air flow output from a compressor). For example, a source of hydrogen gas (e.g., hydrogen from a vessel or hydrogen output form a process unit of a plant that includes the boiler 1, etc.) can be fed to the first flow 19*f* of the mixture of pulverized coal and transport fluid. This feeding can occur before the first flow 19*f* is fed into the inlet 19*i* of the first pulverized coal entrained fluid flow conduit 19. In some embodiments, the mixing of the hydrogen H2 can occur via a mixing device positioned upstream of the inlet 19*i* or via the hydrogen being fed into a feed conduit through which a mixture of solid coal particulates entrained in air or other primary oxidant fluid is passing to include hydrogen into the feed that forms the first flow of the mixture of pulverized coal and transport fluid so that this mixture also includes hydrogen. A control valve CV can be positioned between a feed conduit for the feed flow of coal entrained within the primary oxidant fluid and the source of hydrogen H2. The control valve can be adjusted between a closed position at which no hydrogen is added to this coal entrained oxidant feed flow and an open position in which the hydrogen is added. The control valve can have multiple open positions so that different feed rates of hydrogen can be passed into the first flow 19*f* of the mixture of pulverized coal and transport fluid that is being fed toward the inlet 19*i* of the first pulverized coal entrained fluid flow conduit 19.

The hydrogen fed into the inlet 10*i* of the hydrogen conduit 10 can be fed from a separate hydrogen feed conduit as may best be seen from FIG. 6. A control valve CV can be positioned between the source of hydrogen for the hydrogen conduit inlet 10*i* and the inlet 10*i*. The control valve can be adjusted between a closed position at which no hydrogen is fed into the hydrogen conduit 10 and at least one open position at which hydrogen is passable into the inlet 10*i* of the hydrogen conduit 10. The control valve CV can have multiple open positions so that different feed rates of hydrogen can be passed into the hydrogen conduit 10 of the burner 5. The adjustment in flow of hydrogen can be made to account for a particular operating condition of the boiler 1, for example.

Embodiments of the burner 5 can include additional structure in the outlet 5*a* of the burner 5 to facilitate formation of a pilot flame 4*h* and generation of a larger flame 4 within the combustion chamber 3, which can emanate from the pilot flame 4. The embodiments shown in FIGS. 7-16 illustrate examples of such burners 5.

For example, the burner 5 can include a tapered outlet 11*o* for the inner hydrogen oxidant conduit 11. The distal end of this outlet can have a tapered portion 32 that is tapered so it is narrower than an upstream intermediate portion of the conduit through which the hydrogen oxidant flow 11*f* passes. The tapering of the outlet 11*o* for the tapered portion 32 can start at a tapering location 11*t* that is upstream of the outlet 11*o*. The tapering of the tapered portion 32 can end at the distal end of the outlet 11*o* or adjacent the distal end to define the tapered portion 32.

The burner 5 can also include a mixing conduit that is spaced apart from the distal end of the tapered portion 32 of the tapered outlet 11*o* of the inner hydrogen oxidant conduit 11 by a gap 33 defined between the outlet 11*o* and the inlet of the mixing conduit 31. The mixing conduit 31 can be positioned between the outlet 190 of the first pulverized coal entrained fluid flow conduit 19 and the tapered outlet 11*o* of the inner hydrogen oxidant conduit 11. For example, the mixing conduit 31 can be positioned along a flow path that is within the second distance d2 along which the hydrogen flow 10*f* and the hydrogen oxidant flow 11*f* can travel as these flows pass out of the outlet 11*o* of the hydrogen oxidant conduit 11 and travel the second distance d2 to the outlet 190 of the first pulverized coal entrained fluid flow conduit 19.

The gap 33 can be defined to facilitate a mixing of a portion of the first flow 19*f* of the mixture of pulverized coal and transport fluid passing through the first pulverized coal entrained fluid flow conduit 19. The gap 33 that is defined can be in fluid communication with the first pulverized coal entrained fluid flow conduit 19 so that a portion of the first flow 19*f* is passed into an inlet 31*i* of the intermediate mixing conduit 31. The solid coal particulates cp entrained within the primary oxidant (and if included also hydrogen added therein) can mix with the hydrogen and hydrogen oxidant flows 10*f*, 11*f* fed into the mixing conduit 31 via its inlet 31*i* to facilitate enlargement or strengthening of the pilot flame 4*h*, which can include ignited coal particulates icp. The portion of the first flow 19*f* passed into the gap 33 for being fed into the mixing conduit 31 can also mix with and/or pass along the hydrogen and hydrogen oxidant flows 10*f*, 11*f* being directed into the mixing conduit 31 while these flows move along a gap distance dg.

The gap distance dg can be a distance between the outlet 11*o* of the inner hydrogen oxidant conduit 11 and the inlet 31*i* of the mixing conduit 31 (e.g., an axial distance between the inlet 31*i* and the outlet 11*o* that spaces apart the outlet 11*o* from the mixing conduit inlet 31*i*). In such embodiments that may have such a gap distance dg, the gap distance dg can be a portion of the second distance d2 and a portion of the third distance d3.

The formed pilot flame can heat other coal particulates output from the first pulverized coal entrained fluid flow conduit 19 in the combustion chamber 3 to form the flame 4 around the pilot flame 4*h*. If hydrogen is included in the first flow 19*f*, the hydrogen can also ignite within the combustion chamber due to the pilot flame 4*h* for formation of the flame 4 in the combustion chamber 3. The inclusion of hydrogen within the first flow 19*f* can be advantageous as the hydrogen will typically ignite prior to the coal due to the low ignition energy and high reactivity of the hydrogen so that the ignited hydrogen within the first flow can subsequently assist in rapid ignition of the coal within the first flow 19*f*.

The flame 4 can emanate into the combustion chamber 3 and away from the burner outlet 5*a*. A recirculation zone 3*a* within the combustion chamber 3 can also be defined in the combustion chamber to facilitate circulation of the coal particulates cp for further ignition of non-ignited coal for improved flame stability and combustion in the combustion chamber 3.

Figure 9:
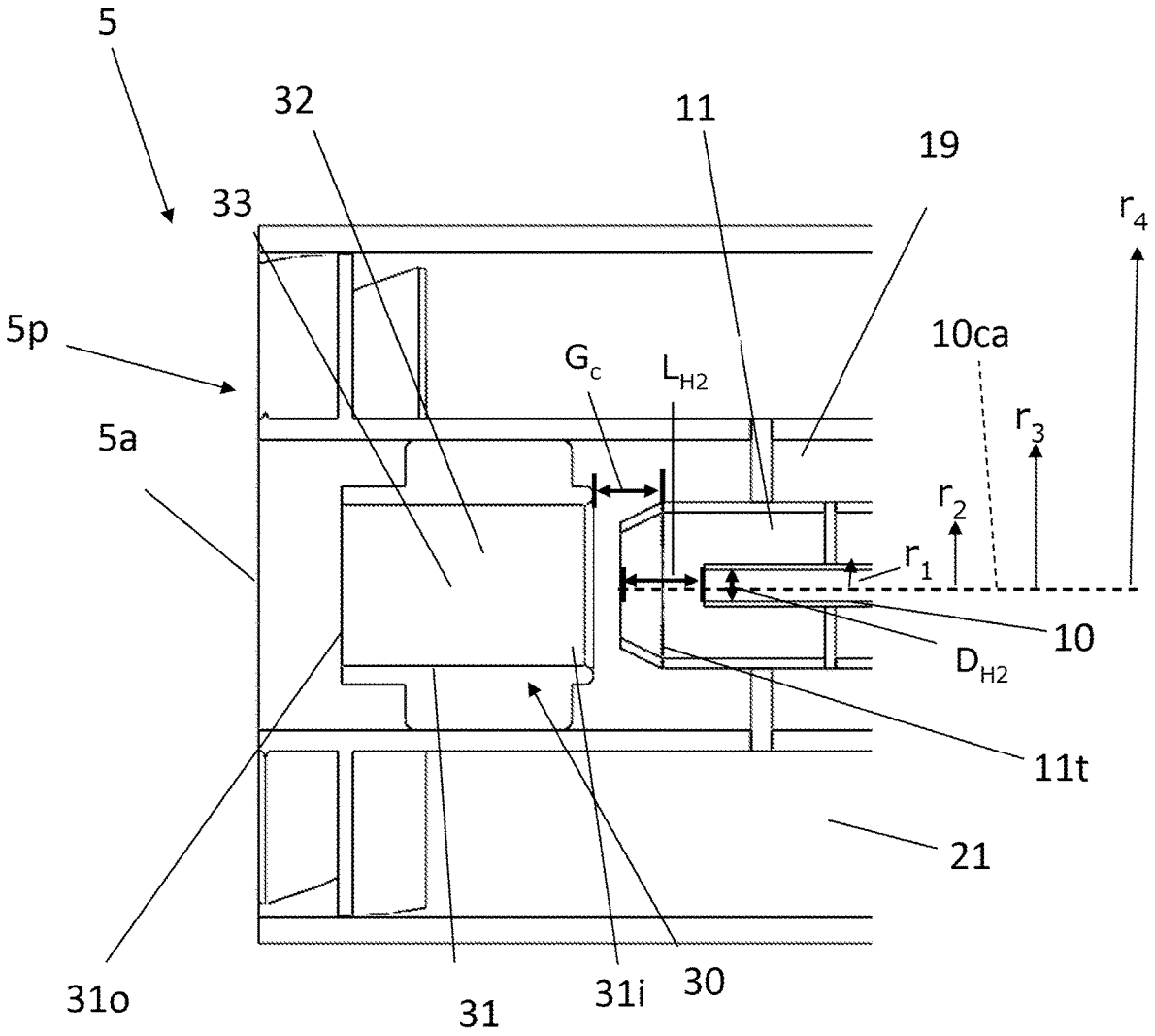
FIG. 9 is a schematic fragmentary view of the burner outlet region of the second exemplary embodiment of the burner 5 that is similar to FIG. 8.
Figure 10:
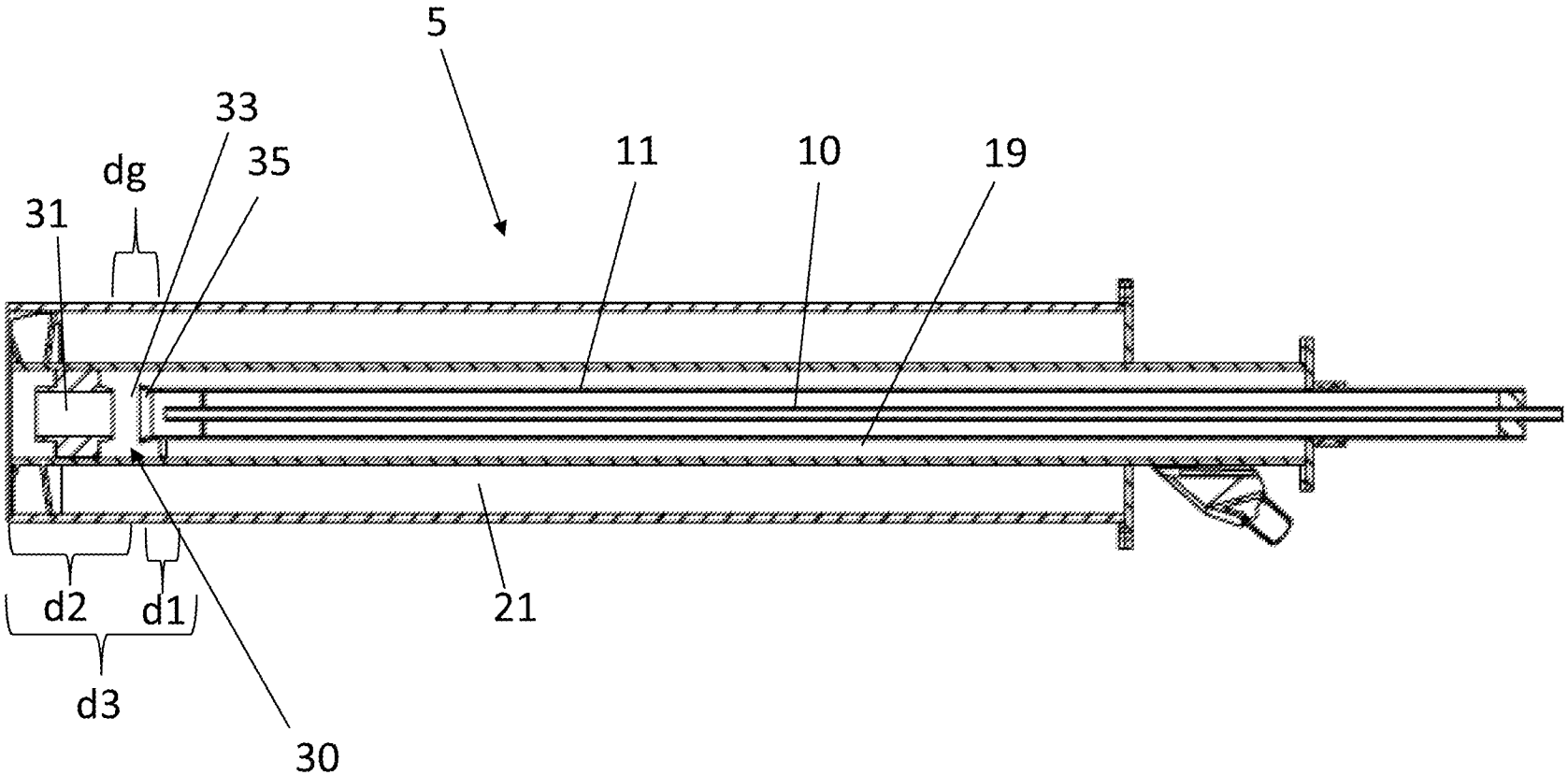
FIG. 10 is a schematic cross-sectional view of a third exemplary embodiment of a burner 5 that can be utilized in the first exemplary embodiment of the boiler.
Figure 11:
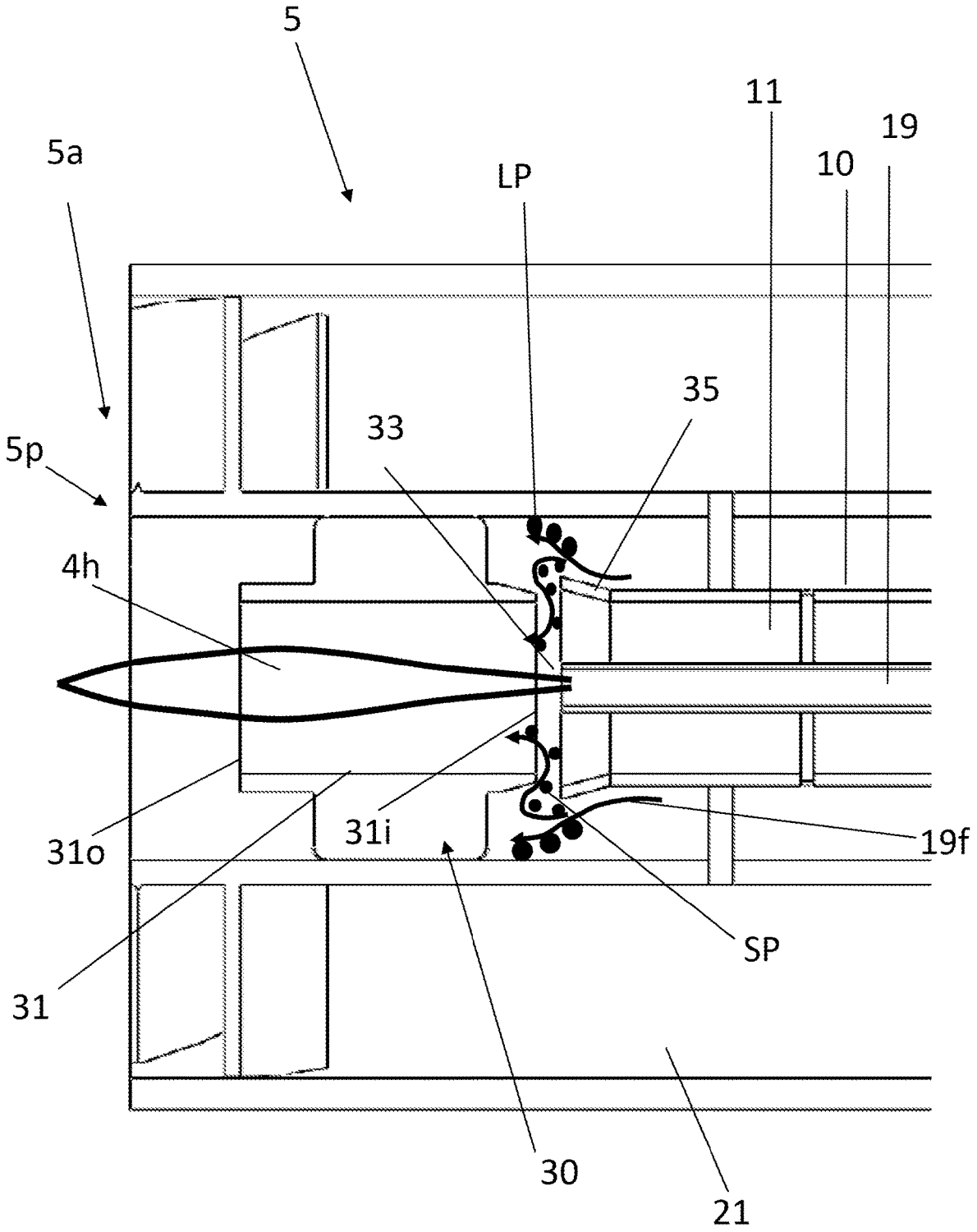
FIG. 11 is a schematic fragmentary view of the burner outlet region of the third exemplary embodiment of the burner 5 generating at least one flame within the combustion chamber 3 of the combustor of the boiler 1 in which the hydrogen conduit 10 extends so that its outlet 10*o* is at a same position as the outlet 11*o* of the inner hydrogen oxidant conduit 11.

As may best be seen from FIG. 9, the mixing conduit 31, inner hydrogen oxidant conduit 11 and hydrogen conduit 10 can be arranged to help provide a desired influx of coal particulates into the mixing conduit 31 to help generate a stronger, more stable flame 4 without quenching the flame while also helping to avoid overheating of certain components (e.g., walls of conduits separating hydrogen oxidizer from the first flow 19*f*, etc.). For example, the outlet 10*o* of the hydrogen conduit 10 can be an axial length LH2 away from the tapered outlet 11*o* of the inner hydrogen oxidant conduit 11. The axial length LH2 can be a linearly extending distance measured along the center axis 10*ca* between the outlet 10*o* of the hydrogen conduit 10 and the outlet 11*o* of the hydrogen oxidant conduit 11.

The hydrogen conduit 10 can also have a diameter DH2 (which can also be considered a width) through which the hydrogen passes as it passes through the hydrogen conduit 10. The inlet 31*i* of the mixing conduit 31 can be positioned to be mixing conduit inlet distance Gc away from the tapering location 11*t* of the inner hydrogen oxidant conduit 11 at which the conduit begins to taper to its distal outlet 11*o*.

The mixing conduit inlet distance Gc can be an axial length between the inlet 31*i* of the mixing conduit 31 and the tapering location 11*t* of the inner hydrogen conduit 11 at which the conduit begins to taper to its outlet 11*o*.

This exemplary arrangement and component configuration can be designed and configured to meet the following conditions:

$$1 \leq L_{H2}/D_{H2} \leq 5 \text{and/or} \quad \text{(i)}$$

$$0.05 \leq ((2*G_c*r_1)/(r_4^2-r_1^2)) \leq 0.15; \quad \text{(ii)}$$

where $r_1$ is the radius of the hydrogen conduit 10, $r_2$ is the radius of the inner hydrogen oxidant conduit 11, $r_3$ is the radius of the first pulverized coal entrained fluid flow conduit 19 and $r_4$ is the radius of the secondary oxidant conduit 21.

In conditions where LH2/DH2 is less than 1, it has been found that the influx of coal particles through the gap 33 can negatively influence initial development of the pilot flame and potentially result in quenching of the pilot flame. For conditions in which LH2/DH2 is greater than 5, it has been found that the suction that can be generated for the influx of coal particulates from the first flow 19*f* can be too diminished and can severely limit the influx of coal particles. It is believed that gas expansion can be a primary reason for this diminished suction effect that has been found to exist in such a condition. Moreover, the additional flame expansion that can result from the LH2/DH2 being greater than 5, can result in overheating of conduit walls or other structure that may separate the flow of hydrogen oxidant passing through the inner hydrogen oxidant conduit 11 from the first flow of 19*f* of the mixture of pulverized coal and transport fluid passing through the first pulverized coal entrained fluid flow conduit 19.

Some embodiments can be configured so that a diameter or width of the mixing conduit is smaller than a diameter or width of the inner hydrogen oxidant conduit 11. This can result in a portion of the outlet 11*o* of the inner hydrogen oxidant conduit projecting into the first pulverized coal entrained fluid flow conduit 19 and can affect how the first flow 19*f* is passed into an inlet 31*i* of the intermediate mixing conduit 31 and toward the outlet 190 of the first pulverized coal entrained fluid flow conduit 19. The effect on this first flow 19*f* that may be provided in such an arrangement can be similar to the effect discussed below with respect to the embodiment of FIGS. 10-14.

As can be appreciated from the embodiment of FIGS. 10-14, the outlet 11*o* for the inner hydrogen oxidant conduit 11 can include an enlarged outlet portion 35 instead of a tapered portion. The distal end of this outlet 11*o* can have a widened, enlarged outlet portion 35 that is widened so it is wider than an upstream intermediate portion of the conduit through which the hydrogen oxidant flow 11*f* passes (e.g., the outlet area can be larger than the cross-sectional area of the hydrogen oxidant conduit 11 upstream of the outlet 11*o*). For example, the outlet of the hydrogen oxidant conduit 11*o* can widen from a widening location to the distal end of the hydrogen oxidant outlet 11*o* so the outlet is wider at the distal end than at the widening location upstream of the distal end of the outlet 11*o*. As may best be seen from FIG. 11, this arrangement can result in an outermost portion of the enlarged outlet portion 35 of the outlet 11*o* extending beyond the inlet 31*i* of the mixing conduit 31. This can result in the enlarged outlet portion 35 projecting into the first pulverized coal entrained fluid flow conduit 19 and can affect how the first flow 19*f* is passed into an inlet 31*i* of the intermediate mixing conduit 31 and toward the outlet 190 of the first pulverized coal entrained fluid flow conduit 19.

For example, the combination of the gap 33 being in fluid communication with the first pulverized coal entrained fluid flow conduit 19 and the projecting portion of the outlet 11*o* that juts into the first pulverized coal entrained fluid flow conduit 19 can help generate a splitting of the first flow 19*f* of the mixture of pulverized coal and transport fluid. This splitting can result in first portion of the first flow 19*f* including smaller sized particulates of coal SP that can pass through the gap 33 and into the inlet 31*i* of the intermediate mixing conduit 31 for mixing with the hydrogen and hydrogen oxidant flows 10*f* and 11*f* fed into the mixing conduit 31. A second portion of the first flow 19*f* including larger sized particulates of coal LP can pass through the first pulverized coal entrained fluid flow conduit 19 and along the outer side(s) of the intermediate mixing conduit 31.

This positioning of the enlarged outlet 11*o* and gap 33 can also contribute to all of the output hydrogen and hydrogen oxidant flows 10*f*, 11*f* passing through the mixing conduit 31. For example, the first portion of the first flow 19*f* that includes the smaller particulates SP being driven through the gap 33 can help force all the hydrogen and hydrogen oxidant of the hydrogen and hydrogen oxidant flows 10*f*, 11*f* to be passed through the mixing conduit 31.

The gap 33 and the outlet 11*o* of the inner hydrogen oxidant conduit 11 can be positioned so that the flow of the fine coal particles (e.g., smaller particulates SP) and associated fraction of the first coal transport fluid which carries these particles through the gap 33 is driven by suction that can be created by the discharge velocity from the hydrogen and hydrogen oxidant passing out of the outlet 11*o* of the inner hydrogen oxidant conduit 11 toward the mixing conduit 31. This discharge velocity can facilitate formation of a high velocity pilot flame 4*h*. To help provide this suction effect, the discharge velocity for the flow output from the outlet 11*o* of the inner hydrogen oxidant conduit can be greater than 45 m/sec (e.g., greater than or equal to 50 m/sec, great than or equal to 100 m/sec etc. while also being below 400 m/sec or other upper limit that may not be practical for a given design, etc.) To provide additional help to create this suction effect on the first flow of the mixture of pulverized coal and transport fluid 19*f* adjacent the gap 33, the outlet plane of the outlet 11*o* can be positioned so that it is not appreciably set back from the upstream end of the gap 33. The suction effect can be adjusted for a particular embodiment by adjustment of the velocity of hydrogen output from the outlet 11*o* of the inner hydrogen oxidant conduit and the relative position between the gap 33 and (i) the outlet 10*o* of the hydrogen conduit 10 and/or (ii) the outlet 11*o* of the inner hydrogen oxidant conduit.

The suction that occurs can result in the mixing of the portion of the first portion of the first flow 19*f* that includes the smaller particulates SP that is passed into the gap 33 for being fed into the mixing conduit 31 also mixing with and/or passing along the hydrogen and hydrogen oxidant flows 10*f*, 1 if being directed into the mixing conduit 31 while these flows move along a gap distance dg. As mentioned above, the gap distance dg can be a distance between the outlet 11*o* of the inner hydrogen oxidant conduit 11 and the inlet 31*i* of the mixing conduit 31 that separates these structures.

The pilot flame 4*h* can be formed as the hydrogen and hydrogen oxidant flows travel along the second distance d2 within the first pulverized coal entrained fluid flow conduit 19 and the mixing conduit 31 positioned therein. The smaller particulate sized coal can also be ignited to increase the chemical energy contained within this pilot flame. The smaller particulate size can be advantageous for the pilot flame 4*h* since the smaller particulates ignite more rapidly than larger particulates of the same chemical composition. The larger sized coal particulates can be output from the outlet 190 of the first pulverized coal entrained fluid flow conduit 19 and pass into the combustion chamber for igniting in the combustion chamber 3 to form the flame that can emanate away from the burner outlet 5*a* around the pilot flame 4*h*. It is contemplated that having smaller sized particulates SP pass into the mixing conduit 31 can rapidly strengthen the pilot flame 4*h* more easily due to the smaller volume and size of the particulates. The added chemical and thermal power of the strengthened pilot flame is then leveraged to more efficiently combust the larger particulates LP output into the combustion chamber 3.

As may best be seen from FIGS. 11-14, embodiments utilizing the enlarged outlet portion 35 can be configured so that the outlet 10*o* of the hydrogen conduit 10 is located in different positions to provide different types of mixing of hydrogen, hydrogen oxidant, and the portion of the first flow 19*f* having coal particulates entrained in fluid that can include an oxidant and/or hydrogen within the mixing conduit 31. The outlet 10*o* can be positioned an axial distance XH2 relative to the outlet 11*o* of the inner hydrogen oxidant conduit 11. The axial distance XH2 can be a linearly extending distance measured along the center axis 10*ca* between the outlet 10*o* of hydrogen conduit 10 and outlet 11*o* of the hydrogen oxidant conduit 11.

Figure 12:
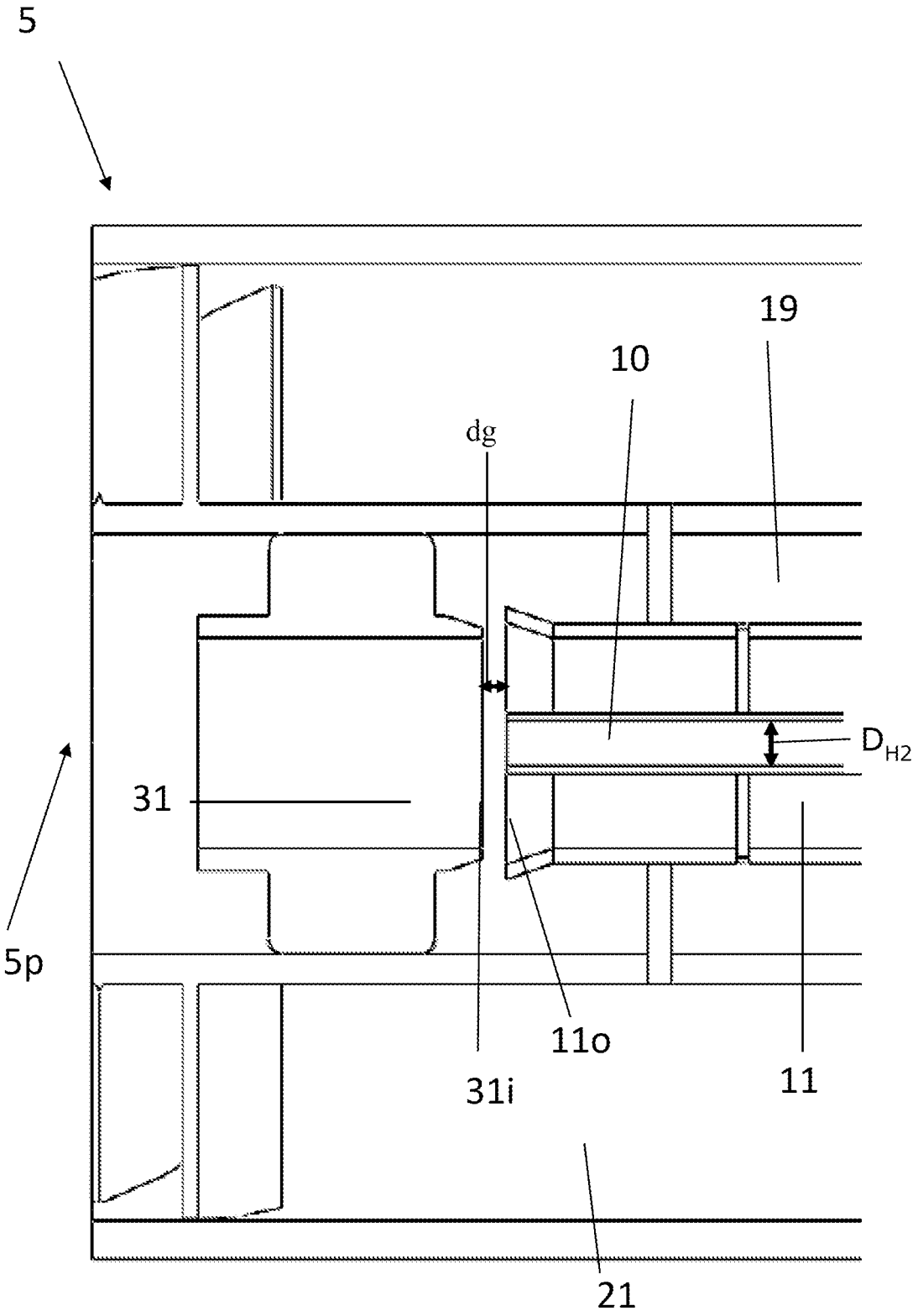
FIG. 12 a schematic fragmentary view of the burner outlet region of the third exemplary embodiment of the burner 5 similar to FIG. 11.
Figure 13:
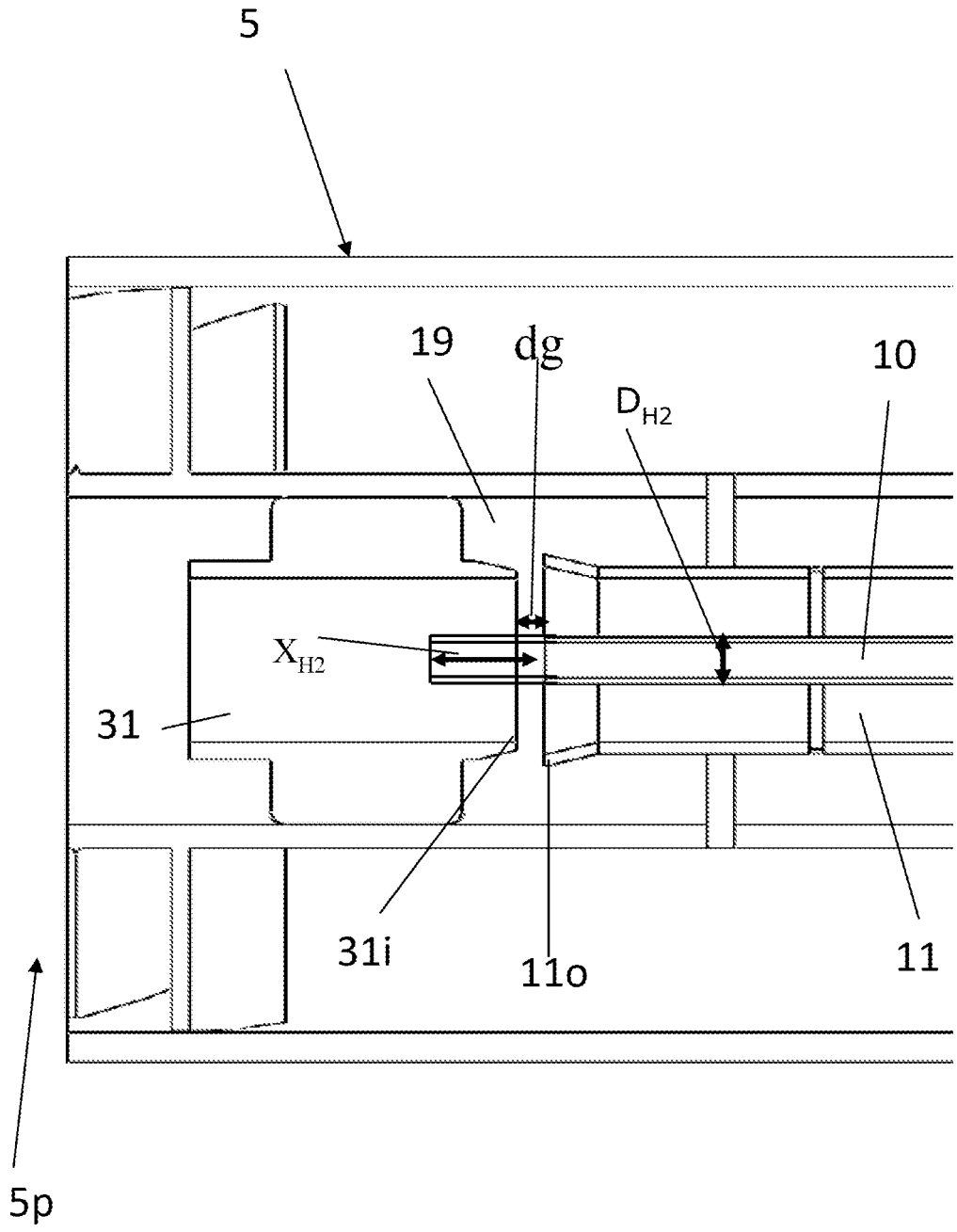
FIG. 13 is a schematic fragmentary view of the burner outlet region of the third exemplary embodiment of the burner 5 similar to FIGS. 11 and 12 that illustrates an exemplary arrangement in which the hydrogen conduit 10 extends beyond the outlet 11*o* of the inner hydrogen oxidant conduit 11 to a position within the mixing conduit 31.
Figure 14:
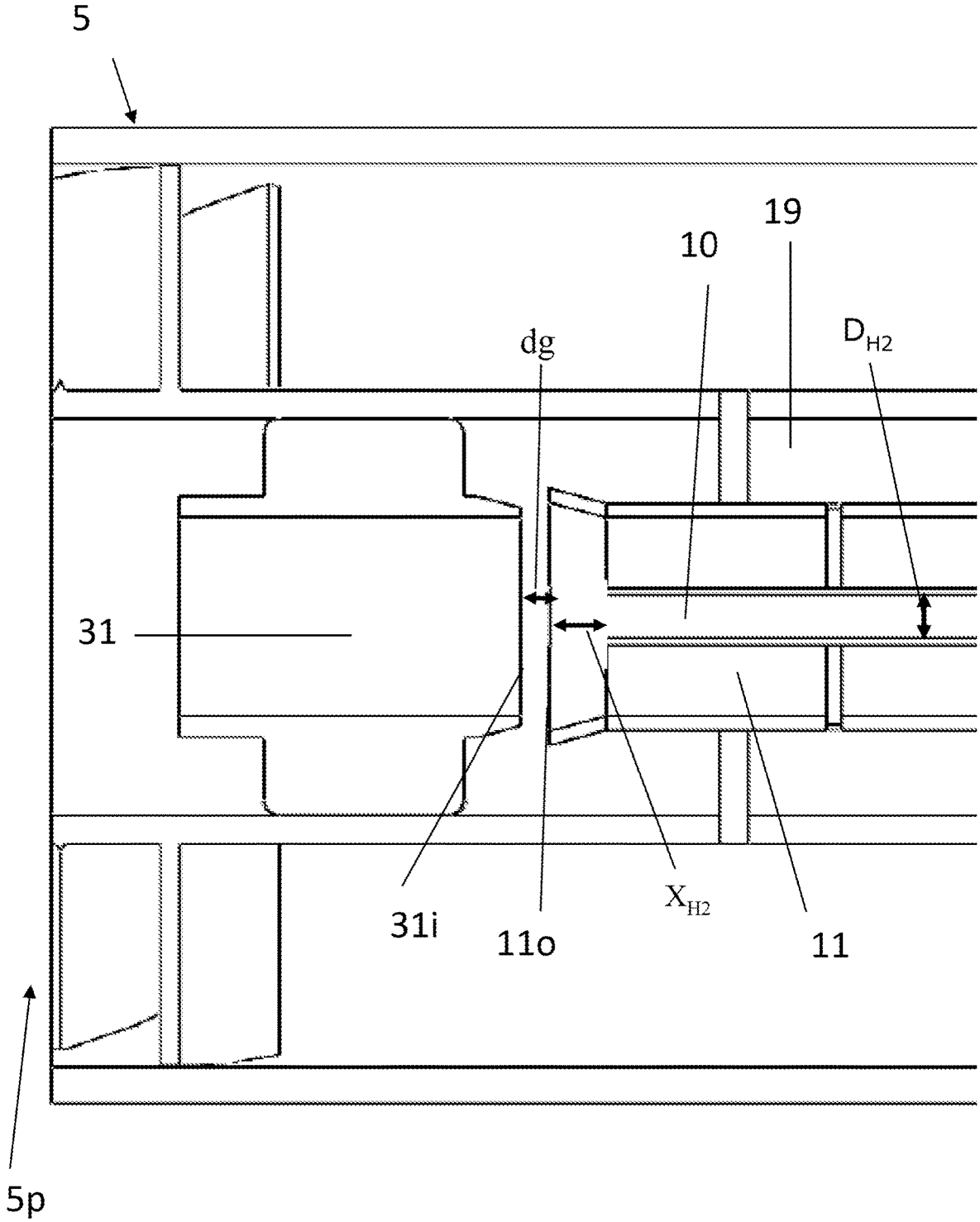
FIG. 14 is a schematic fragmentary view of the burner outlet region of the third exemplary embodiment of the burner 5 similar to FIGS. 11, 12 and 13 that illustrates an exemplary arrangement in which the hydrogen conduit 10 is positioned within the inner hydrogen oxidant conduit 11 such that the outlet 11*o* of the inner hydrogen oxidant conduit 11 is positioned between the inlet 31*i* of the mixing conduit 31 and the outlet 10*o* of the hydrogen conduit 10.

In the embodiment of FIG. 14, the axial distance XH2 is less than 0 (e.g., the outlet 11*o* is positioned downstream of the outlet 10*o* such that the axial distance XH2 is −1 mm or less, −2 mm or less, −1 cm or less, etc.). In the embodiment of FIG. 12, the axial distance XH2 is 0 because the outlet 10*o* is coincident with the outlet 11*o* (e.g., both outlets terminate at the same position such that axial distance XH2 is 0 mm, 0 cm, etc.). In the embodiment of FIG. 13, the axial distance XH2 is greater than 0 (e.g., the axial distance XH2 is more than 0.1 mm or more than 0.1 cm, more than 1 mm, etc.).

These exemplary arrangements and component configurations of FIGS. 10-14 can be designed and configured to meet the following conditions:

$$-1 \le X_{H2}/D_{H2} \le 5 \text{and/or} \quad \text{(i)}$$

$$0.05 \le ((2*dg*r_1)/(r_4^2 - r_1^2)) \le 0.15; \quad \text{(ii)}$$

where dg is the gap distance dg, which can be an axial distance between the outlet 11*o* of the inner hydrogen oxidant conduit 11 and the inlet 31*i* of the mixing conduit 31, $r_1$ is the radius of the hydrogen conduit 10, $r_2$ is the radius of the inner hydrogen oxidant conduit 11, $r_3$ is the radius of the first pulverized coal entrained fluid flow conduit 19 and $r_4$ is the radius of the secondary oxidant conduit 21.

It should be appreciated that the above noted linearly measured distances for radiuses r1-r4 can be distances that extend perpendicularly from the center axis 10*ca* to a particular inner side of an outer wall of a conduit.

The utilization of the above noted conditions can help optimize embodiments for a particular set of design criteria. It has been found that embodiments utilizing the enlarged outlet portion 35 can require greater suction than embodiments utilizing another type of outlet 11*o* configuration (e.g., tapered outlet or uniform diameter outlet) due to the more acute bending of the particle flow path that can be needed for the influx of coal particulates to pass into the gap 33 toward the inlet 31*i* of the mixing conduit 31. For the same suction, the mass flow of coal particulates may be lower for embodiments utilizing the enlarged outlet portion 35 as compared to embodiments utilizing a tapered outlet 11*o* or uniform diameter outlet 11*o*, for example. Also, the size distribution of the particulates that pass through the gap 33 for the coal particulate influx for being fed to the mixing conduit 31 can be finer (e.g., smaller in size distribution), which can result in the particle surface area to mass ratio also being higher. This can facilitate more rapid coal particulate ignition via the pilot flame to help strengthen the pilot flame and improve its stability. This can also mean that the quenching of the pilot flame is not as significant of a concern as it can be for the above discussed exemplary embodiment of FIGS. 7-9. Instead, the arrangement and configuration to help meet a pre-selected level of particulate suction can be a more significant factor for designs of the embodiments of FIGS. 10-14.

For some embodiments, the positioning of the outlet 10*o* of the hydrogen conduit 10 to be downstream of the outlet 11*o* of the inner hydrogen oxidant conduit 11 (e.g., the axial distance XH2 is greater than 0), can be preferred as such positioning can help generate a desired level of suction due to the jet wake from the output of the hydrogen from the outlet 10*o* of the hydrogen conduit 10.

For the embodiments of FIGS. 10-14, it has been found that for an XH2/DH2 of greater than 5, jet wake suction can diminish and the hydrogen conduit 10 can be more susceptible to coal particle impingement and erosion. It has also been found that for an XH2/DH2 of less than −1, the pressure that can be generated from the outputting of a jet of hydrogen from the hydrogen conduit's outlet 10*o* can lead to diminishment of suction and prevention of coal particle entrainment (e.g., coal particulates passing into the gap and inlet 33*i* of the mixing conduit and being entrained within the flow of fluid within the mixing conduit etc.).

Figure 15:
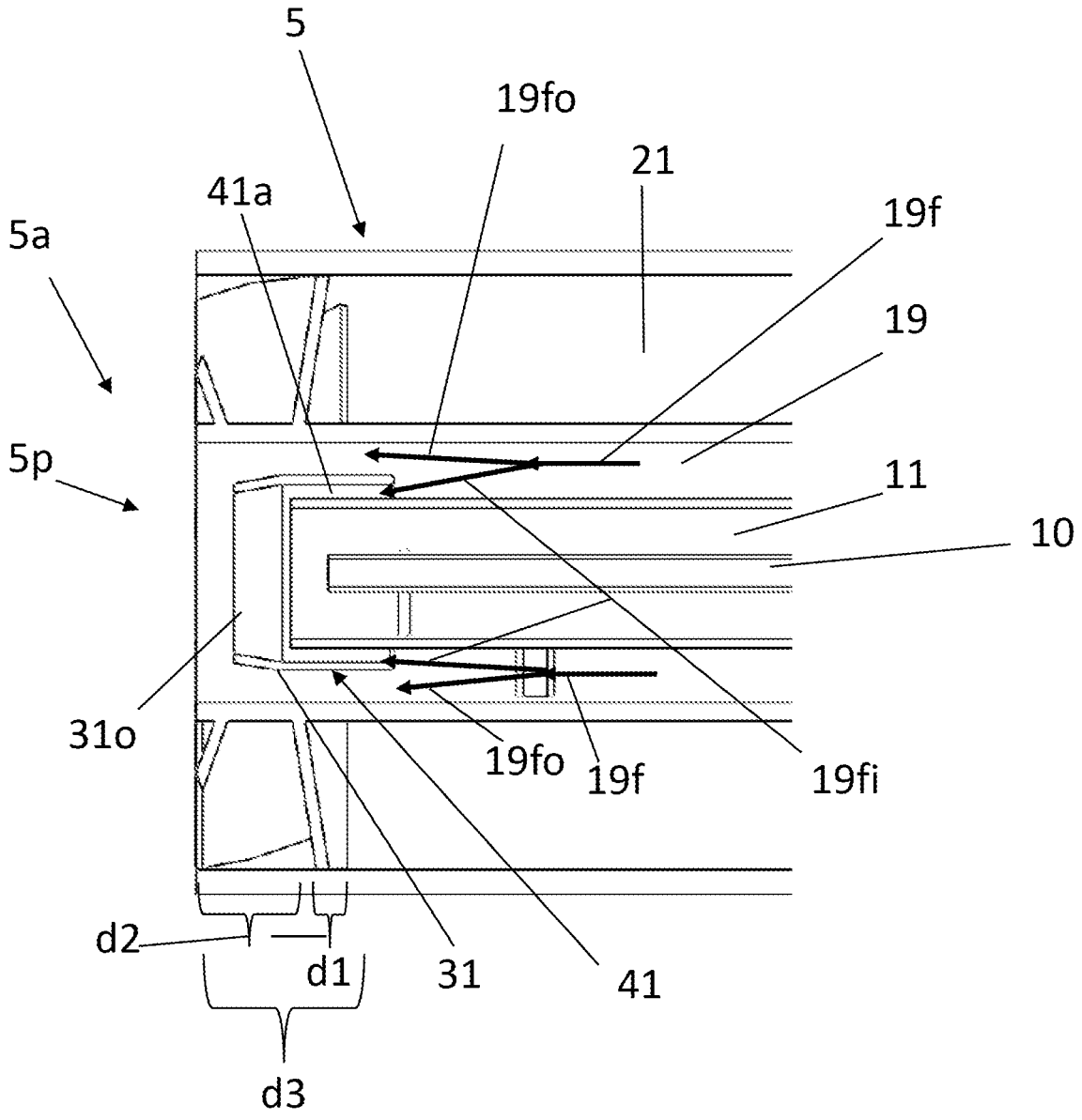
FIG. 15 is schematic fragmentary view of the burner outlet region of a fourth exemplary embodiment of the burner.
Figure 16:
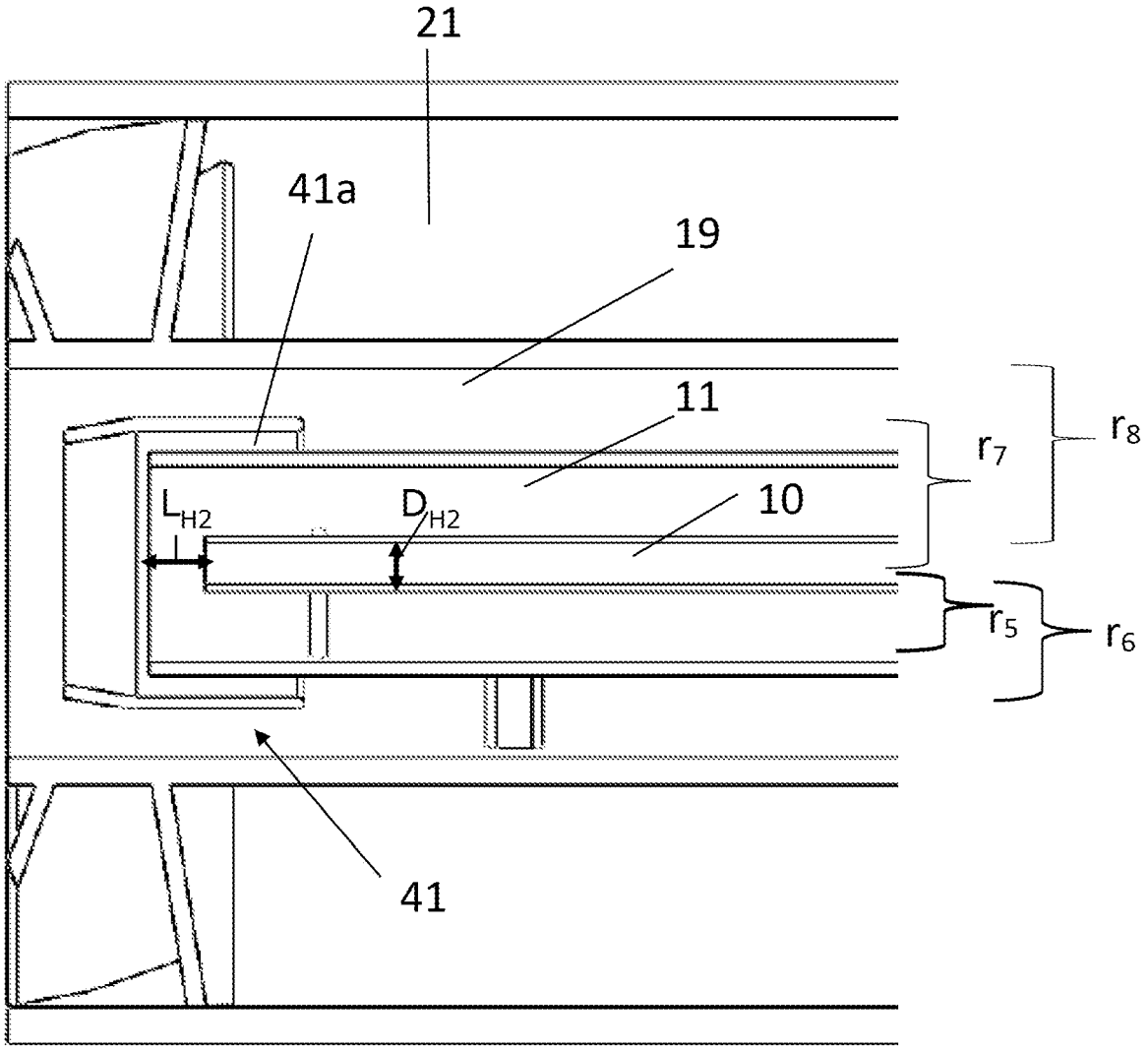
FIG. 16 is a schematic fragmentary view of the burner outlet region of the fourth exemplary embodiment of the burner similar to FIG. 15.

FIGS. 15-16 illustrates another burner outlet 5*a* arrangement that can utilize a splitter 41 that defines a radial gap for splitting the first flow 19*f* of the mixture of pulverized coal and transport fluid (e.g., coal mixed with an oxidant flow such as air or oxygen enriched air and optionally also hydrogen as discussed above) into a first inner flow portion 19*fi* and a second outer flow portion 19*fo*. The splitter 41 can be a portion of the mixing conduit that is positioned to encircle an outer peripheral portion of the outlet region of the hydrogen oxidant flow conduit 11 or can be a portion that is attached to the mixing conduit or positioned adjacent to the mixing conduit 11. For example, the splitter 41 can be positioned around an outlet 11*o* of the hydrogen oxidant conduit 11 within the first pulverized coal entrained fluid flow conduit 19 to split the first flow 19*f* so that the inner flow portion 19*fi* of the first flow is fed through a passageway 41*a* defined between the inner side of the body of the splitter 41 and the outer side of the inner hydrogen oxidant conduit 11 and into the mixing conduit 31. The mixing conduit 31 has an outlet 310 that is positioned downstream of the outlet 11*o* of the hydrogen oxidant conduit 11. The flows of hydrogen, hydrogen oxidant, and the inner flow portion 19*fi* (which can be considered a first portion of the first flow 19*f*) can be passed through the mixing conduit 31 to facilitate mixing of these flows therein and formation of the pilot flame 4*h*.

The outlet 310 of the mixing conduit 31 can provide a convergent termination to facilitate more rapid mixing of the inner flow portion 19*fi* with the pilot flame 4*h* as well. For example, the outlet 310 of the mixing conduit can be narrower than its inlet 31*i* or an intermediate portion between its inlet 31*i* and its outlet 310 to provide such a convergent termination. In other configurations, the mixing conduit 31 can include a tapered configuration in which the cross-sectional area through which the flow of fluid and coal particulates passes is larger at its inlet 31*i* and smaller at its outlet 310 and/or intermediate portion to facilitate more rapid mixing of the coal particulates from the inner flow portion 19*fi* with the pilot flame 4*h* and the hydrogen and hydrogen oxidant passing through the mixing conduit 31.

An outer flow portion 19*fo* of the first flow 19*f* (which can also be considered a second portion of the first flow 19*f*) can pass through the first pulverized coal entrained fluid flow conduit 19 along an outer side of the mixing conduit 31 so that this flow portion stays separated from the hydrogen and hydrogen oxidant flows passing through the mixing conduit 31.

The splitter 41, mixing conduit 31, inner hydrogen oxidant conduit 11 and hydrogen conduit 10 can be arranged to help provide a desired influx of coal particulates to help generate a stronger, more stable flame 4 without quenching the flame while also helping to avoid overheating of certain components (e.g., walls of conduits separating hydrogen oxidizer from the first flow 19*f*, etc.). For example, the outlet 10*o* of the hydrogen conduit 10 can be an axial length LH2 away from the outlet 11*o* of the inner hydrogen oxidant conduit 11. The hydrogen conduit 10 can also have a diameter DH2 (which can also be considered a width) through which the hydrogen passes as it passes through the hydrogen conduit 10. The conduits can also be arranged and positioned so that their different radiuses (e.g., r1, r2, r3, and r4) help promote a desired level of radial mixing of coal particulates.

For example, the exemplary arrangement and component configuration for the embodiment of FIGS. 15-16 can be designed and configured to meet the following conditions:

$$1 \le L_{H2}/D_{H2} \le 5 \text{and} \quad \text{(i)}$$

$$0.05 \le ((r_6^2 - r_5^2)/(r_8^2 - r_7^2)) \le 0.25; \quad \text{(ii)}$$

where radius $r_5$ is the outer radius of the hydrogen conduit 10, radius $r_6$ is the inner radius of the splitter 41, radius $r_7$ is the outer radius of the splitter 41 and radius $r_8$ is the inner radius of the first pulverized coal entrained fluid flow conduit 19.

In such configurations, radius r5 can be a linearly measured distance that an inner side of an outer wall of the hydrogen oxidant conduit 11 is from the center axis 10*ca* (radius r5 can also be considered a radius of the hydrogen oxidant conduit 11 (similar to radius r2 discussed above). Radius r6 can be a linearly measured distance between the center axis 10*ca* and an inner side of the splitter 41. Radius r7 can be a linearly measured distance between an outer side of the splitter 41 and the center axis 10*ca*. Radius r8 can be a linearly measured distance between an inner side of an outer wall of the first pulverized coal entrained fluid flow conduit 19 and the center axis 10*ca*. Each of the above noted linearly measured distances for radiuses r5-r8 can be a linear distance that extends perpendicularly from the center axis 10*ca*.

The (r62-r521)/(r82-r72)) ratio can be considered a ratio of cross-sectional areas Ar. This ratio Ar can be a ratio of the cross-sectional area between the inner and outer coal flow passages separated by the splitter 41.

In conditions where LH2/DH2 is less than 1, it has been found that the influx of coal particles through the passageway 41*a* can be too high and can negatively influence initial development of the pilot flame and potentially result in quenching of the pilot flame. For conditions in which LH2/DH2 is greater than 5, it has been found that the suction that can be generated for the influx of coal particulates from the first flow 19*f* can be too diminished and can severely limit the influx of coal particles. It is believed that gas expansion can be a primary reason for this diminished suction effect that has been found to exist in such a condition. Moreover, the additional flame expansion that can result from the LH2/DH2 being greater than can result in overheating of conduit walls or other structure that may separate the flow of hydrogen oxidant passing through the inner hydrogen oxidant conduit 11 from the first flow of 19*f* of the mixture of pulverized coal and transport fluid passing through the first pulverized coal entrained fluid flow conduit 19.

Figure 17:
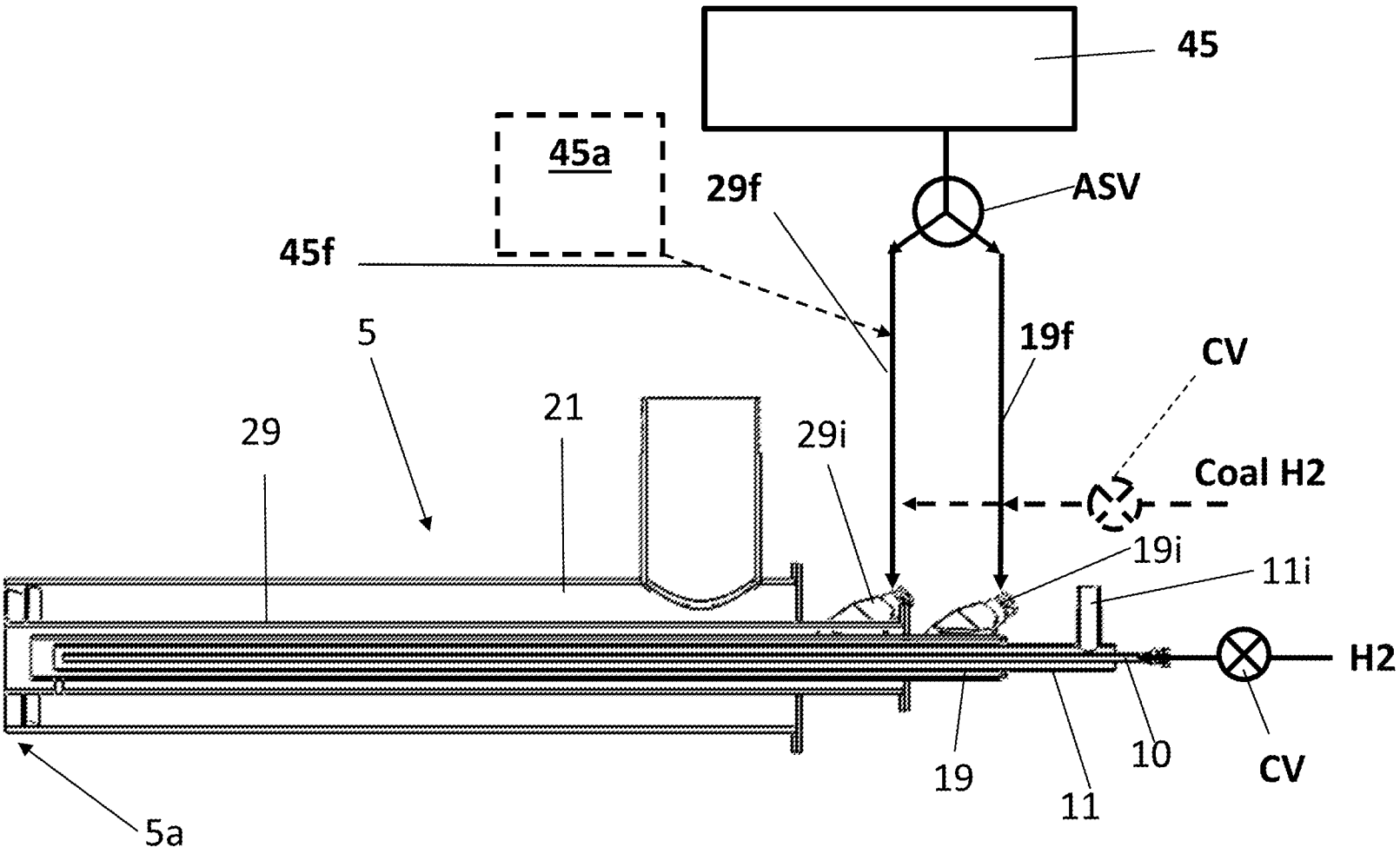
FIG. 17 is a schematic view of the fifth exemplary embodiment of a burner that can be utilized in the first exemplary embodiment of the boiler that includes a schematic illustration of feed flows fed to the burner. A hydrogen feed for including hydrogen into a flow of pulverized coal mixed with a primary air flow (e.g., air, a primary oxidant flow for mixing with the solid particulates of the pulverized coal, etc.) is shown in broken line.
Figure 18:
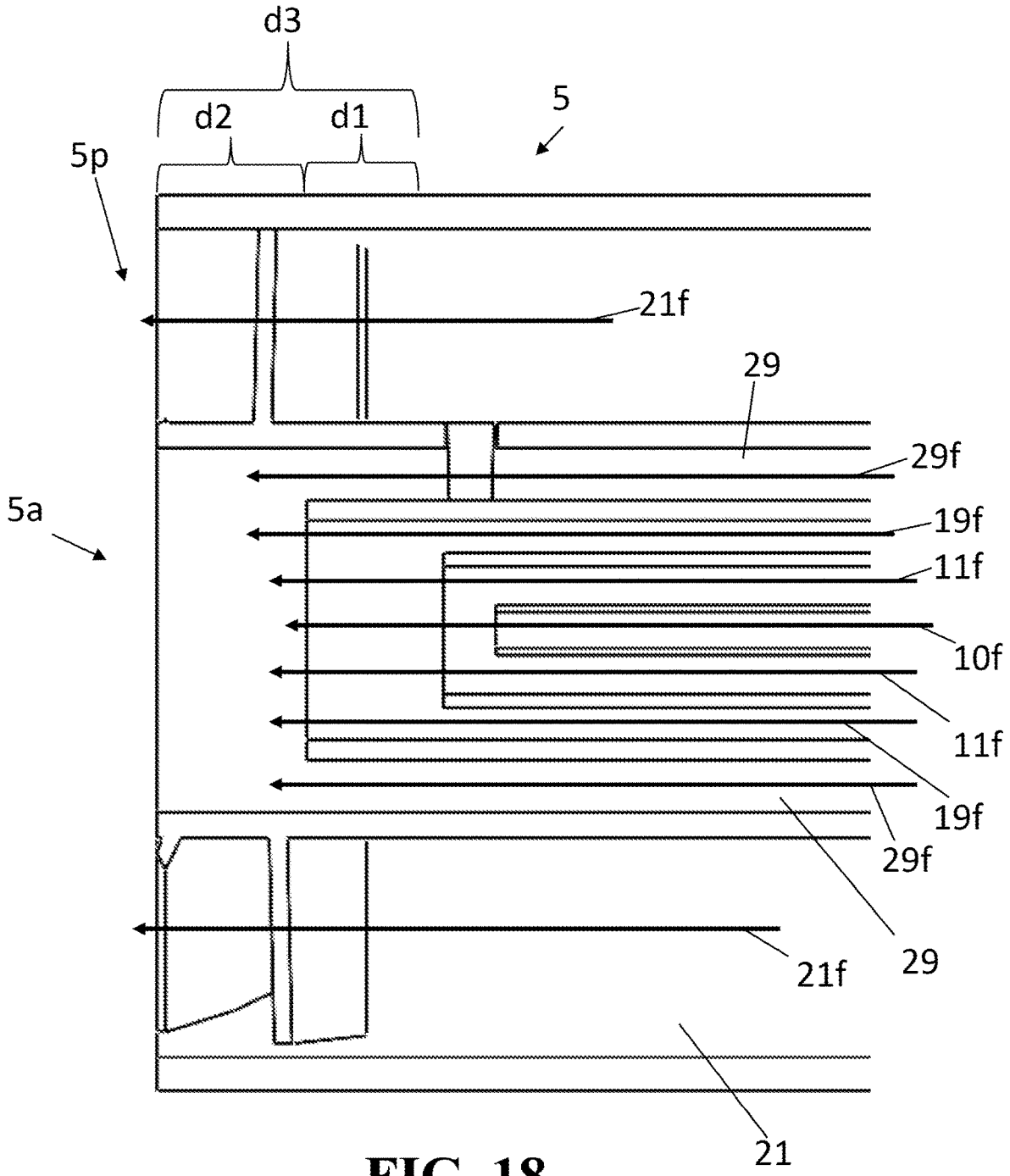
FIG. 18 is a schematic fragmentary view of the burner outlet region of the fifth exemplary embodiment of the burner.

FIGS. 17 and 18 illustrate another embodiment of the burner that can utilize the first pulverized coal entrained fluid flow conduit 19 and the second pulverized coal entrained fluid flow conduit 29. As can best be seen from FIG. 17, a feed of coal entrained in a primary transport gas can be fed from at least one primary fuel source 45 toward the inlets 19*i* and 29*i* of the first and second pulverized coal entrained fluid flow conduits 19, 29. The primary fuel source 45 can be considered a source of pulverized coal or a source of pulverized coal entrained in a primary oxidant (e.g., air, oxygen enriched air, etc.). An adjustable splitter valve AVS can be positioned between the primary fuel source 45 and the inlets 19*i*, 29*i* to adjust flows of coal entrained in the primary oxidant fed toward the inlets. The adjustable splitter valve AVS can be positioned so that the feed flow of coal entrained in the primary oxidant is split so a first portion of the feed is fed to the inlet 19*i* of the first pulverized coal entrained fluid flow conduit 19 and a second portion of the feed is fed to the inlet 29*i* of the second pulverized coal entrained fluid flow conduit 29. In some configurations, these portions can be split so that most of the coal and primary oxidant is fed to the outer second pulverized coal entrained fluid flow conduit 29. For instance, 5%-40%, 10%-40%, 15%-30% or 10%-20% of the coal entrained in the primary oxidant can be fed to the first pulverized coal entrained fluid flow conduit 19 and the remaining portion of the fuel (e.g., 60%-95%, 60%-90%, 85%-70%, 80%-90%, etc.) can be fed to the second pulverized coal entrained fluid flow conduit 29.

In other embodiments, there can be a second source of coal 45*a* (shown in broken line) that can be utilized to feed coal to the second pulverized coal entrained fluid flow conduit 29 via a second coal source feed conduit 45*f* connected to the feed conduit for feeding a flow of pulverized coal to the inlet 29*i* of the second pulverized coal entrained fluid flow conduit 29. This feeding of coal from the second source of coal 45*a* can occur while the first coal source 45 is utilized to provide coal to the first pulverized coal entrained fluid flow conduit 19. In some embodiments, the first coal source 45 can be utilized to provide coal to the first pulverized coal entrained fluid flow conduit 19 and the second pulverized coal entrained fluid flow conduit 29 and the second coal source 45*a* can be utilized to mix additional coal from another coal source to the feed for the second pulverized coal entrained fluid flow conduit 29.

The second source of coal 45*a* can provide a source of coal that has different coal from the first source of coal. For instance, the second source of coal 45*a* can have coal that is of a larger particle size distribution or a smaller particle size distribution and/or also include a different type of coal that has a different composition and/or different combustion properties. The option of utilizing multiple sources of different types of coal can help provide operational flexibility and allow for adjustment in how the coal is fed to the combustion chamber to allow for improved flame generation and stability within the combustion chamber.

Hydrogen can also be included in the fuel feeds fed to the first and/or second pulverized coal entrained fluid flow conduits 19 and 29. Such an arrangement may best be appreciated from FIG. 17. Similar to the control valve CV arrangement shown in FIG. 6 discussed above, hydrogen can be fed for mixing into a feed to be fed to the inlet 19*i* of the first pulverized coal entrained fluid flow conduit 19. This same type of arrangement can be utilized to feed hydrogen to the second pulverized coal entrained fluid flow conduit 29, or for feeding hydrogen to both the feeds to be fed to the first and second pulverized coal entrained fluid flow conduits 19 and 29.

In some arrangements for FIGS. 17-18, hydrogen may not be fed or injected into the second pulverized coal entrained fluid flow conduit 29 and hydrogen can be injected or included only in the first coal entrained fluid flow conduit 19. In such configurations, utilization of hydrogen in only the first coal entrained fluid flow conduit 19 (as well as the hydrogen utilized via the inner hydrogen conduit 10) can more advantageously be used to ignite the "inner" coal stream, which may then further strengthen the pilot flame.

In other arrangements that may include hydrogen being injected into the second flow 29*f*, the second flow 29*f* of a mixture of pulverized coal and transport fluid can include hydrogen gas included with air or oxygen enriched air and pulverized coal particulates. A hydrogen feed H2 can be fed to mix with pulverized coal and an oxidant fluid (e.g., gaseous air, gaseous oxygen enriched air, an air flow output from a compressor). For example, a source of hydrogen gas (e.g., hydrogen from a vessel or hydrogen output form a process unit of a plant that includes the boiler 1, etc.) can be fed to the second flow 29*f* of the mixture of pulverized coal and transport fluid. This feeding can occur before the second flow 29*f* is fed into the inlet 29*i* of the second pulverized coal entrained fluid flow conduit 29. In some embodiments, the mixing of the hydrogen H2 can occur via a mixing device positioned upstream of the inlet 29*i* or via the hydrogen being fed into a feed conduit through which a mixture of solid coal particulates entrained in air or other primary oxidant fluid is passing to include hydrogen into the feed that forms the first flow of the mixture of pulverized coal and transport fluid so that this mixture also includes hydrogen. A control valve CV can be positioned between a feed conduit for the feed flow of coal entrained within the primary oxidant fluid and the source of hydrogen H2. The control valve can be adjusted between a closed position at which no hydrogen is added to this coal entrained oxidant feed flow and an open position in which the hydrogen is added. The control valve can have multiple open positions so that different feed rates of hydrogen can be passed into the second flow 29*f* of the mixture of pulverized coal and transport fluid that is being fed toward the inlet 29*i* of the second pulverized coal entrained fluid flow conduit 29.

Referring to FIG. 17, the utilization of the second pulverized coal entrained fluid flow conduit 29 can allow different flow rates of coal entrained within a primary oxidant to be utilized at different locations relative to the formed pilot flame 4*h*. This can help provide further adjustability in the output of coal, oxidant, and hydrogen into the combustion chamber via the burner 5 for flame generation so that a stable flame can be provided with improved operational performance, reduced CO2 emission, and reduced particulate generation.

For example, the second pulverized coal entrained fluid flow conduit 29 can be utilized so that a larger or smaller flow rate of coal entrained with oxygen is output from the outlet 290 into the combustion chamber as compared to the outlet of the first pulverized coal entrained fluid flow conduit 19. Such an output of different coal flow rates from the different outputs can allow adjustment in flame generation to account for different fuel types, operational conditions in the boiler, formation of a desired recirculation zone 3*a* within the combustion chamber, and other operational parameters.

Embodiments of the burner 5 can permit replacement of pre-existing conventional devices that utilize diesel, propane, or natural gas. This can permit a removal of onsite storage for such fuels as well as avoid utilization of higher soot-laden flames that generate high particulate emissions that are not well-captured in electrostatic precipitators or other filter devices. This can improve emissions output from the boiler as well as reduce fire hazards that can be present due to bag houses or other particulate retention devices used in such filtration devices.

Further, embodiments of the burner 5 can permit utilization of hydrogen as a pilot flame fuel. This can provide greater load turndown flexibility and a faster ramp rate. For instance, the hydrogen fuel fed via the inner hydrogen conduit 10 can provide enhanced flammability for generation of a pilot flame that can be more quickly adapted to a higher flow rate for increasing the rate at which the flame temperature can be increased within the combustion chamber 3.

Further, embodiments of the burner can provide significant advantages over plasma torches or other conventional devices that require use of a cooling water circuit. As compared to these types of devices, embodiments of the burner 5 can be more durable (e.g., have a significantly longer usable life cycle for the boiler) while also provide greater operational flexibility and reduced maintenance.

Utilization of hydrogen that can be provided by embodiment of the burner 5 can also allow for use of hydrogen storage infrastructure that may already be present in a conventional plant. For instance, hydrogen is often utilized for generator cooling. The pre-existing hydrogen storage infrastructure can be utilized to feed hydrogen to the hydrogen conduit to allow embodiments of the burner 5 to be more easily retrofitted into a pre-existing boiler.

Hydrogen as a fuel source for the pilot flame generation can also provide a more highly reactive fuel with a higher flame temperature as compared to diesel, propane, or natural gas. This can permit more rapid and efficient burning of the coal or other fossil fuels.

Embodiments of the burner 5 can also permit hydrogen utilization to be relatively low for providing a generated flame. This can permit the boiler 1 to have improved cold start operations by use of the hydrogen for generation of the pilot flame 4*h* while also providing enhanced turndown during periods of lower demand for the boiler 1. The enhanced turndown feature can be provided by adjusting the flow rate of hydrogen output from the burner to account for lower demand, for example. Moreover, embodiments of the burner can be relatively inexpensive and include lower capital costs as compared to conventional devices, such as plasma torches. Embodiments of the burner were utilized in confidential testing that was performed to evaluate the operational improvements embodiments of the burner 5 could provide. In a first test, an embodiment having the structure of the embodiment shown in FIGS. 2-6 was evaluated. A second test was conducted to evaluate an embodiment of the burner 5 shown in FIGS. 7-9. A third test was performed to further evaluate an embodiment of the burner shown in FIGS. 2-6. For these tests, the burners were installed in a pulverized coal test furnace for the conducted testing.

The below Table 1 illustrates the testing results from the first testing performed using an embodiment similar to the embodiment shown in FIGS. 2-6.

TABLE 1

Test results for testing of first exemplary embodiment of the burner

| Test PT # | Furnace Wall Temp (° F.) | Coal Firing Rate (MMBtu/hr) | Hydrogen Thermal Energy Input (% of Coal Firing Rate) | CO concentration (ppm) | Flame Condition |
|---|---|---|---|---|---|
| 1 | Less than 100 | 2.3 | 6.9 | 1550 | Stable |
| 2 | Less than 570 | 3 | 8.0 | 723 | Stable |
| 3 | Less than 570 | 3 | 8.0 | 246 | Stable |
| 4 | Less than 570 | 3 | 8.0 | 261 | Stable |
| 5 | 610 | 3 | 8.0 | 199 | Stable |
| 6 | 633 | 3 | 6.9 | 177 | Stable |
| 7 | 654 | 3 | 5.6 | 174 | Stable |
| 8 | 682 | 3 | 4.5 | 158 | Stable |
| 9 | 701 | 3 | 3.5 | 157 | Stable |

Figure 7:
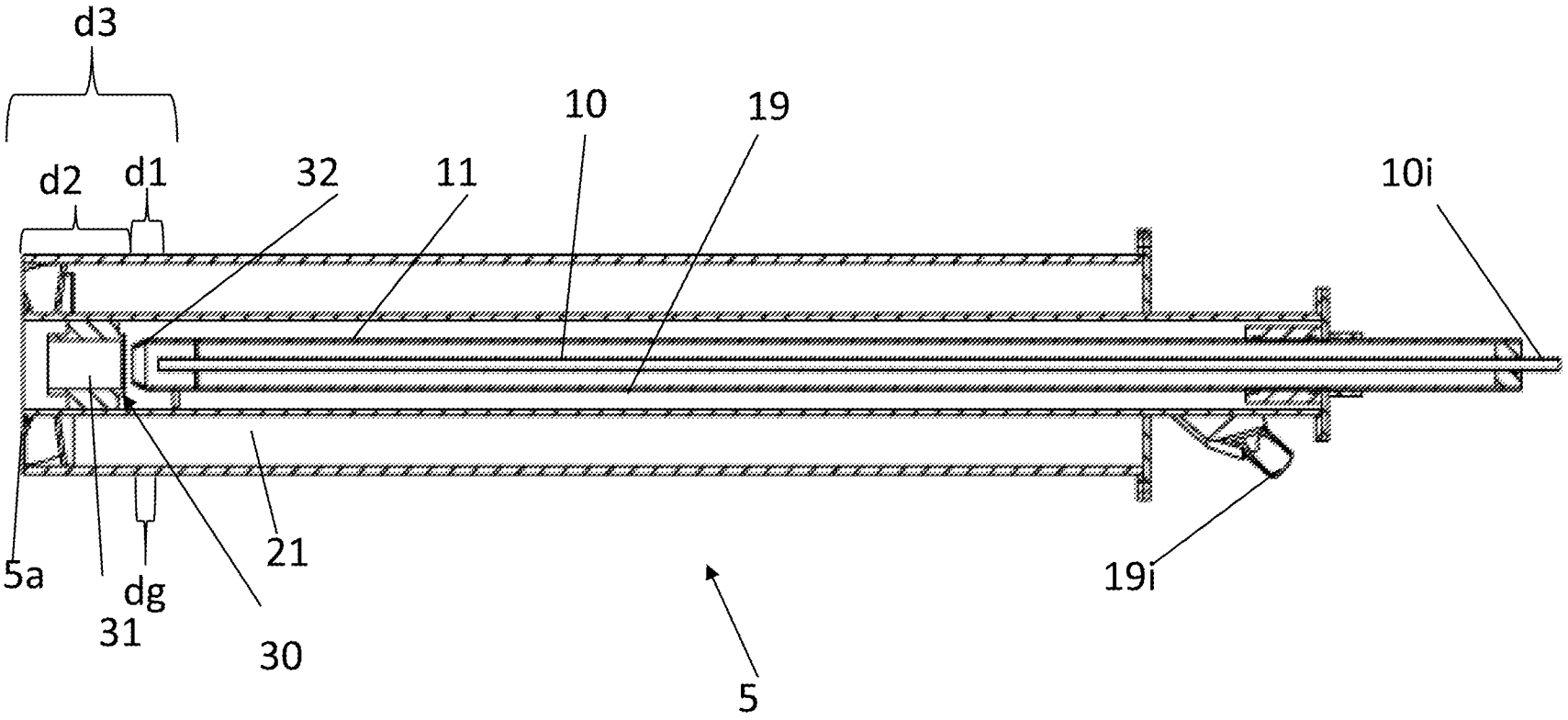
FIG. 7 is a schematic cross-sectional view of a second exemplary embodiment of a burner 5 that can be utilized in the first exemplary embodiment of the boiler.
Figure 8:
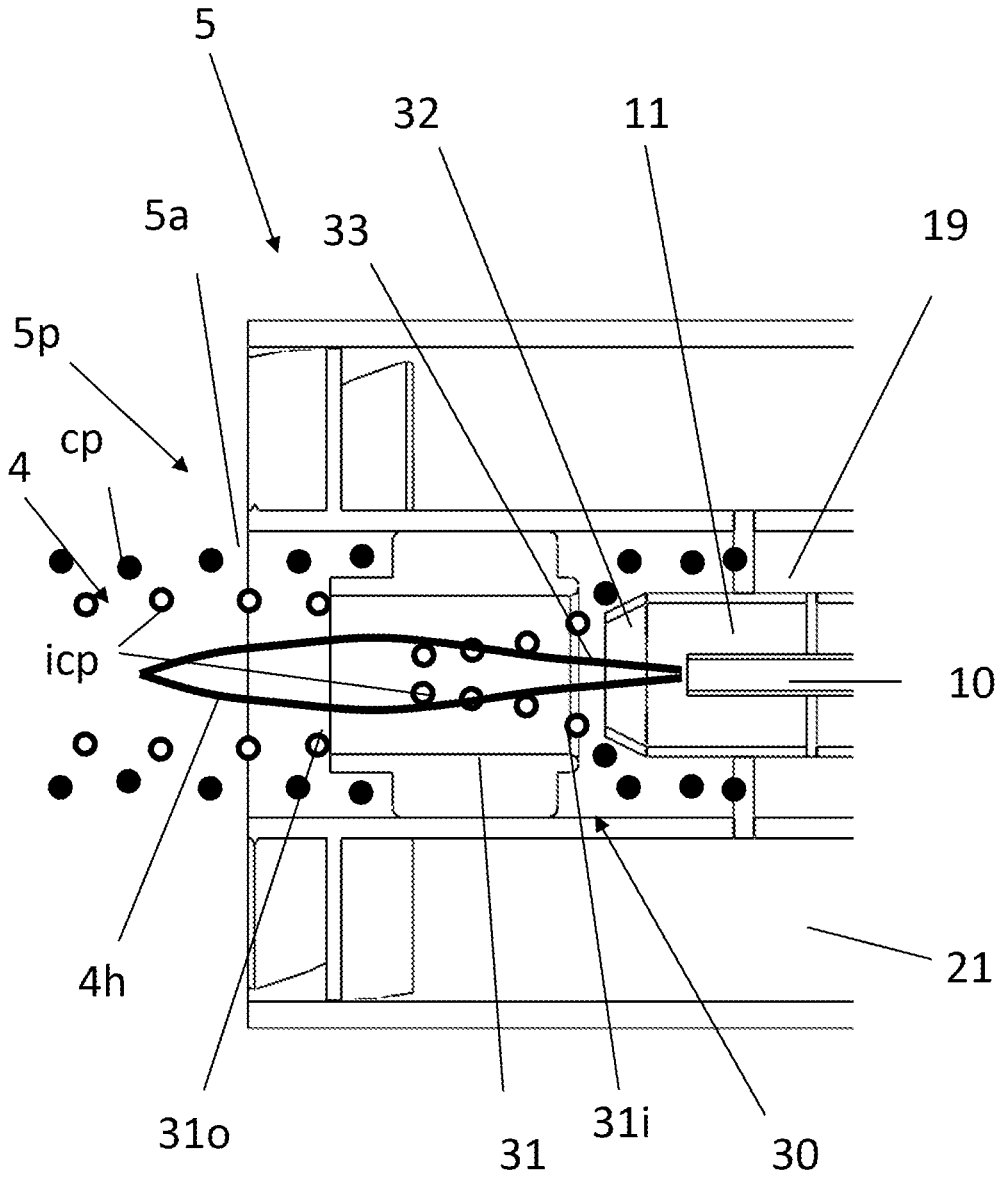
FIG. 8 is a schematic fragmentary view of the burner outlet region of the second exemplary embodiment of the burner 5 generating at least one flame within the combustion chamber 3 of the combustor of the boiler 1.

The below Table 2 illustrates the testing results from the second testing performed using an embodiment similar to the embodiment shown in FIGS. 7-9.

TABLE 2

Test results for testing of second exemplary embodiment of the burner

| Test # | Furnace Avg Wall Temp (° F.) | Coal Firing Rate (MMBtu/hr) | H2 Thermal Energy Input (% of Coal Firing Rate) | H2 Nozzle Velocity (m/sec) | Diverted Coal (% of Total) | CO Conc (ppmv) | Flame Condition |
|---|---|---|---|---|---|---|---|
| 1 | Less than 100 | 3 | 8.0 | 300 | 8.0 | 293 | Stable |

TABLE 2-continued

Test results for testing of second exemplary embodiment of the burner

| Test # | Furnace Avg Wall Temp (° F.) | Coal Firing Rate (MMBtu/hr) | H2 Thermal Energy Input (% of Coal Firing Rate) | H2 Nozzle Velocity (m/sec) | Diverted Coal (% of Total) | CO Conc (ppmv) | Flame Condition |
|---|---|---|---|---|---|---|---|
| 2 | Less than 570 | 3 | 6.9 | 260 | 6.3 | 191 | Stable |
| 3 | 606 | 3 | 5.6 | 210 | 4.5 | 100 | Stable |
| 4 | 650 | 3 | 4.5 | 170 | 3.2 | 103 | Stable |
| 5 | 746 | 3 | 3.5 | 130 | 2.0 | 108 | Stable |
| 6 | 818 | 3 | 2.4 | 90 | 1.1 | 98 | Stable |
| 7 | 872 | 3 | 1.1 | 40 | 0.3 | 79 | Stable |
| 8 | 917 | 3 | 1.1 | 40 | 0.3 | 85 | Stable |

As can be appreciated from the above, the test results from both embodiments were quite satisfactory. The results shown in Table 2 demonstrate higher efficiency (e.g., lower CO emissions, lower hydrogen flow rate) relative to the results shown in Table 1. For instance, the CO emissions is an indicator that a portion of the coal is not being fully combusted and is generally well-correlated with the level of unburned carbon leaving the boiler. The lowering of the CO emissions that can be provided therefore shows that more coal is being combusted and less unburned coal is leaving the boiler (e.g., the boiler is operating more efficiently and combusting more of the coal).

It is believed that the improved test results obtained for the second test of the second exemplary embodiment of the burner occurred because of the controlled splitting of the coal and primary oxidant flow that occurs just upstream from the outlet 5*a* of the burner that can be provided via the gap 33 and/or mixing conduit 31. The fraction of the coal that is diverted to the hydrogen flow and hydrogen oxidant flow 10*f*, 11*f* output from the hydrogen oxidant conduit outlet 11*o*, is a complex function of the hydrogen velocity exiting the central conduit, the diameter of the hydrogen oxidant conduit, the gap size, the coal particle size distribution, and the velocity of the coal/primary oxidant flow. For the test results presented in Table 2, the calculated the range of diverted coal was between about 0.3% and 8% of the total incoming coal flow rate to the burner, while the hydrogen nozzle velocity varied, respectively, between about 40 and 300 m/sec. As the burner dimensions and coal supply were fixed for these same tests, the controlling factor governing the diverted coal fraction during these tests was found to be the hydrogen nozzle velocity. The testing that was conducted showed that, for optimizing performance in accordance with a first set of design criteria, a maximum hydrogen nozzle velocity can be sized in accordance with the maximum percentage required for the diverted coal stream. The test results indicate that the additional diverted coal mixed with the hydrogen via the mixing conduit 31 can help augments the pilot flame 4*h* generated via the hydrogen and hydrogen oxidant flows, increasing the flame's power and thereby improving its ability to effectively ignite and combust the balance of the coal exiting the burner outlet 5*a*.

We have found that a suitable maximum value of the diverted coal stream that can be required during the initial startup of a coal fired boiler to meet some pre-selected set of design criteria can be no higher than about 25% of the total burner coal flow rate, and a preferred maximum range can be between about 5% and 15% of the total burner coal flow rate. The balance, or un-diverted portion of the coal stream (e.g., the 75% or more of the total burner coal flow rate or the 85%-95% of the total burner coal flow rate) passes along the exterior of the mixing conduit 31 so it does not mix with the hydrogen before being output from the outlet 5*a* of the burner.

Figure 20:
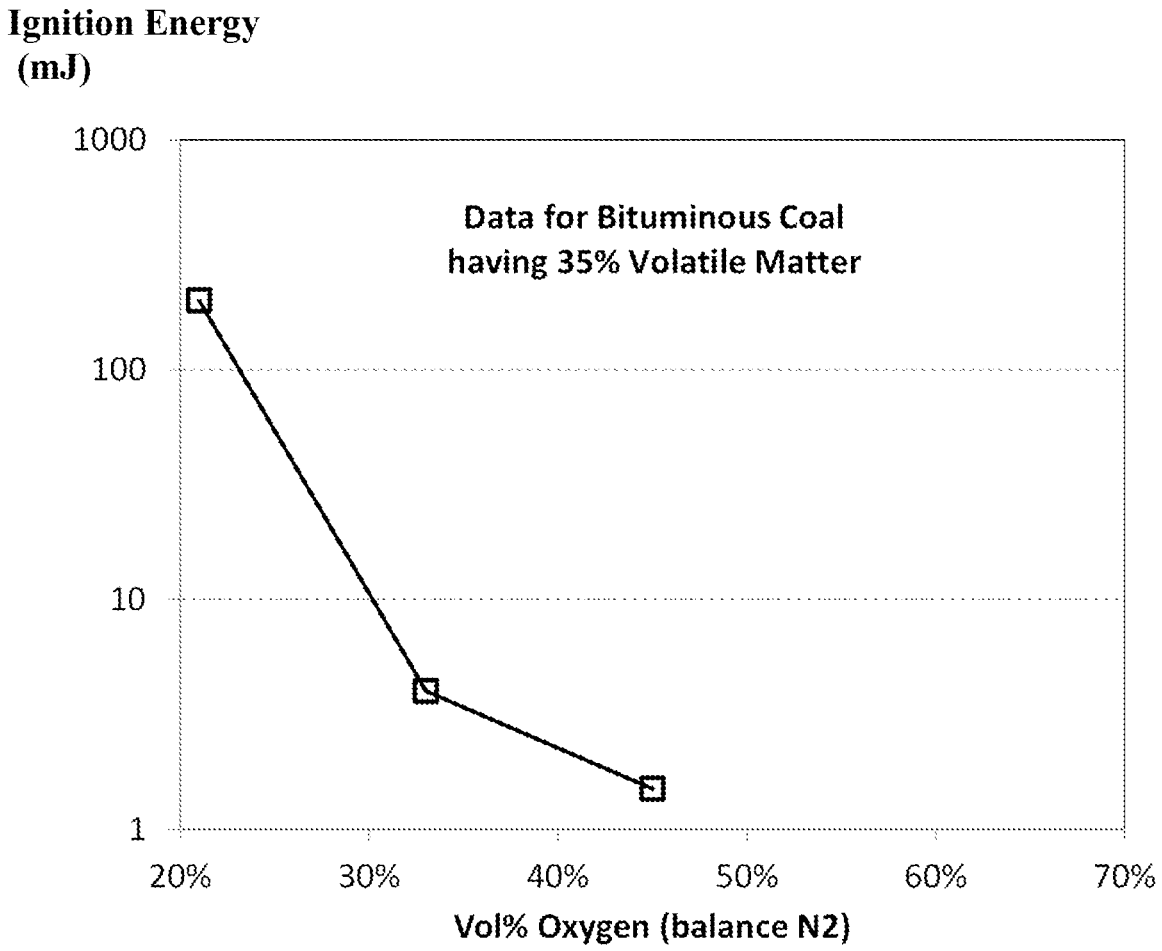
FIG. 20 is a graph illustrating testing results from testing conducted on an exemplary embodiment of the burner utilizing an exemplary embodiment of the process for generating at least one flame in a combustion chamber 3.

FIGS. 20 and 21 illustrate the testing results from additional third testing performed using an embodiment similar to the embodiment shown in FIGS. 2-6. The testing results of FIGS. 20-21 were obtained from testing conducted using the burner embodiment of FIGS. 2-6. These tests were conducted to determine the effectiveness of using elevated concentration of oxygen in the hydrogen oxidizer (e.g., hydrogen oxidant conduit 11) to enhance flame stability, especially after startup during part load operation of a coal-fired boiler.

Results from the conducted third testing are summarized in FIG. 21. For this third testing that was conducted, there was no hydrogen used. The hydrogen was not utilized in this testing because the conducted testing was conducted following startup so that the combustion chamber wall temperature was similar to that of a boiler at reduced operating load. The oxygen concentration in the hydrogen oxidant flow output from the hydrogen oxidant conduit 11 was systematically decreased from 40 vol % to 20.9 vol % by increasing a flow rate of nitrogen gas (N2) in the hydrogen oxidant flow while keeping a flow rate of oxygen (O2) fixed at approximately 7.5% of the total oxidant oxygen (O2) used for combustion (the balance being oxygen within primary and secondary air passing through the secondary air conduit 21 and the first coal entrained fluid flow conduit 19). As the oxygen (O2) concentration was lowered during the testing, the stability of the coal flame weakened until flame blowoff occurred at an oxygen concentration of 20.9 vol %.

The reason for the improvement in flame stability at higher oxygen concentration that was observed in this conducted testing is believed to be the substantial reduction in coal ignition energy. Ignition energy data were independently acquired for a bituminous coal having 35% volatile matter and are summarized in FIG. 20. An approximately 100-fold reduction in required ignition energy was found to exist during the testing as the oxidizer oxygen (O2) concentration was increased from 20.9 vol % to 45 vol %. The reduction is steepest for oxygen concentrations just above the oxygen concentration in air, and asymptotically approaches a limiting low value as the oxygen concentration was increased. The testing that has been conducted suggested that a concentration of oxygen in the hydrogen oxidant flow passed through the inner hydrogen oxidant conduit 11 greater than about 35 vol % can be sufficient for maintaining part load coal burner flame stability under conditions where blowoff would exist with air as the hydrogen oxidizer. The results also show that elevated oxygen concentration could also enable reduced hydrogen consumption during startup operations.

These test results further exemplify the significant improved operation embodiments of the burner can provide while also providing improved emissions that have less particulates while additionally permitting implementation to incur lower operational and capital costs.

Figure 19:
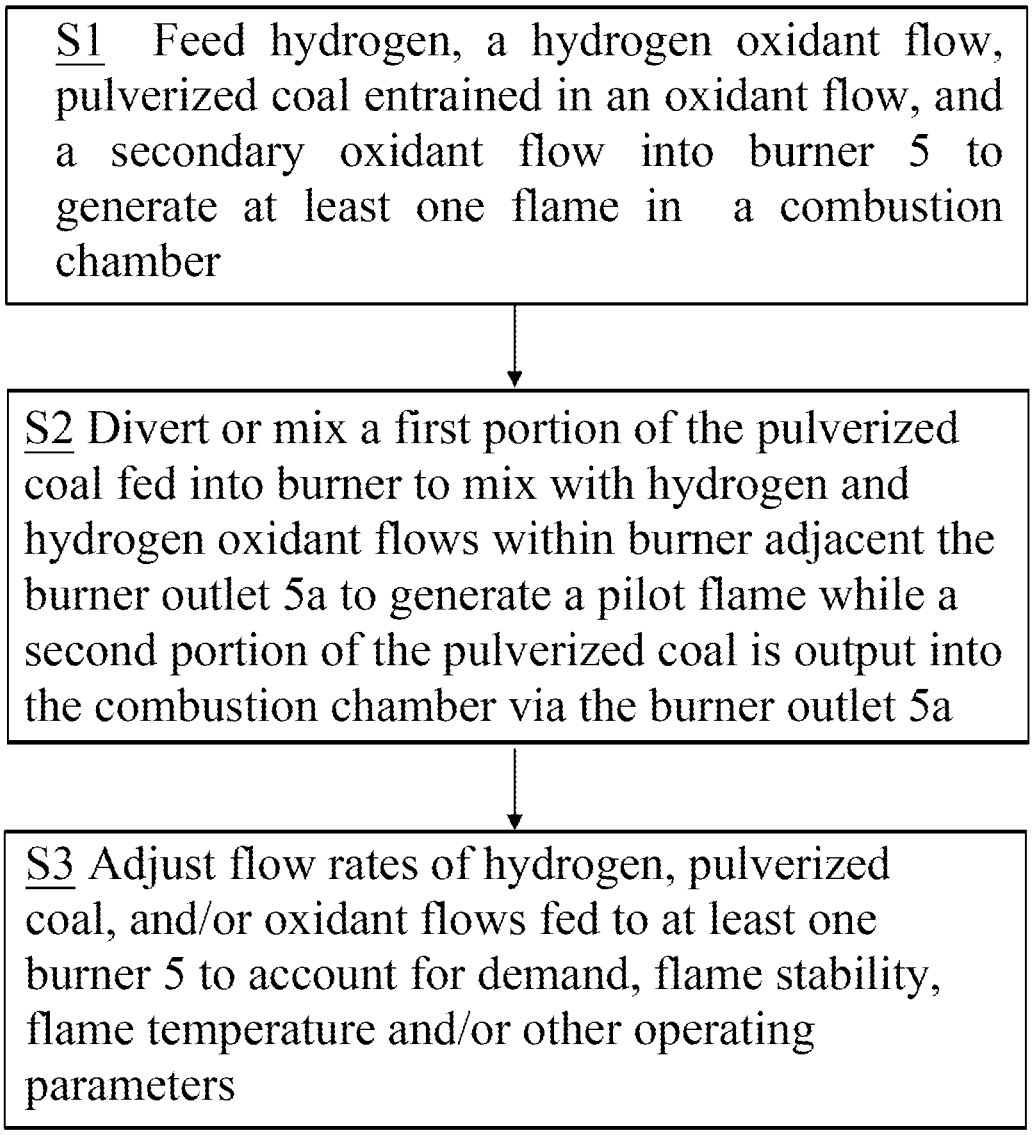
FIG. 19 is a flow chart illustrating an exemplary process for generating at least one flame in a combustion chamber 3.

Embodiments of the burner 5 discussed herein can also be utilized in processes for operating a boiler 1 and other types of combustion devices that can include a combustion chamber 3. Embodiments of the process can be utilized in conjunction with a combustion chamber utilizing particulate coal material as a primary fuel to form at least one flame 4 in the combustion chamber 3, for example. FIG. 19 illustrates an example of such a process. For example, in a first step S1, a boiler 1 or other device having a combustion chamber 3 can be started up to generate at least one flame 4 in the combustion chamber 3 by feeding flows of hydrogen, hydrogen oxidant, pulverized coal entrained in an oxidant, and a secondary oxidant into at least one burner. In a second step S2 of the process, a first portion of the pulverized coal fed into the burner can be mixed with the hydrogen and hydrogen oxidant flows passing through the burner while these flows are within the burner near an outlet 5*a* of the burner 5 to generate a pilot flame 4*h* while a second portion of the pulverized coal is passed through the burner and output into the combustion chamber via the burner outlet 5*a*. The pilot flame 4*h* that is generated can emanate out of the outlet 5*a* of the burner and into the combustion chamber to facilitate combustion of the second portion of the coal in the combustion chamber to generate the flame within the combustion chamber 3. After the combustion chamber has reached a pre-selected threshold operational temperature or is within a pre-selected operational temperature range, the flow rates of hydrogen, pulverized coal, and/or oxidant flows fed to one or more of the burners 5 can be adjusted to account for demand, flame stability, flame temperature and/or other operating parameters in a third step S3.

The third step S3 can include several different actions. For example, the third step S3 can include stopping the injection of hydrogen into the combustion chamber after the combustion chamber is at a desired temperature and/or after the flame formed in the combustion chamber has sufficient flame stability. The injection of hydrogen can then also be resumed during operation of the boiler to facilitate a lower boiler load with enhanced flame stability, which can be desired prior to turndown of the boiler, for example. Also (or alternatively), the resuming of hydrogen injection can occur, or the rate of hydrogen being fed to the burner 5 for outputting from the burner 5 can be increased prior to ramping up from one boiler load to another, higher boiler load. This increased or resumed injection of hydrogen can help speed up the ramping rate of temperature within the combustion chamber.

As yet another example, during a part load operation, the third step S3 can include feeding the hydrogen oxidant flow to the burner while the hydrogen is no longer being injected. The hydrogen oxidant flow can include an elevated concentration of oxygen to help improve part load operations without further use of hydrogen injection. As discussed above, utilization of such an enhanced oxygen concentration in the hydrogen oxidant flow can be utilized to enhance flame stability during part load operation while hydrogen is no longer being injected into the burner or output from the burner (e.g., via the inner hydrogen conduit 10).

Embodiments of the process can also utilize other elements or steps. For example, the mixing of the pulverized coal with the hydrogen and hydrogen oxidant flow can be facilitated via having those flows pass along the second distance d2 as they move toward the outlet 5*a* or via use of a mixing conduit 31 and/or a splitter 41. As another example, the flow of pulverized coal can be split into the first and second portion while also selecting for particulate size by having smaller sized particulates within the flow of coal particulates diverted into the flow of hydrogen and the flow of hydrogen oxidant. This can be provided by utilization of a gap 33 and an enlarged outlet for the hydrogen oxidant conduit as discussed above, for example. As another example, hydrogen can be mixed with the pulverized coal entrained within the primary oxidant prior to that flow being fed to the burner for use in conjunction with a primary flow of hydrogen passed through an inner hydrogen conduit 10 as discussed above. The pulverized coal within such a flow can then be diverted so the first portion is mixed with the primary flow of hydrogen output from the hydrogen conduit 10 and the hydrogen oxidant flow output from the hydrogen oxidant conduit 11 as those flows pass along the second distance d2 toward the outlet 5*a* of the burner 5.

Embodiments of the process can also include other steps. For example, before the first step S1, an embodiment of the burner can be retrofitted into a pulverized coal boiler. An older conventional burner can be replaced with an embodiment of the burner 5, for instance. Additionally, conduits can be adjusted or provided to feed at least one hydrogen flow, oxidant flows, and/or at least one pulverized coal entrained in an oxidant flow or other type of transport fluid to the installed burner. An embodiment of this type of process can also be considered a process for installing a burner into a boiler for improved operation of the boiler or for retrofitting the boiler to include at least one new burner.

As another example, the process can also include building a new boiler for a plant and including an embodiment of the burner in the new boiler. An embodiment of this type of process can also be considered a process for installing a new boiler.

Embodiments of the process, boiler 1, and burner 5 can be configured to include process control elements positioned and configured to monitor and control operations (e.g., temperature and pressure sensors, flow sensors, an automated process control system having at least one work station that includes a processor, non-transitory memory and at least one transceiver for communications with the sensor elements, valves, and controllers for providing a user interface for an automated process control system that may be run at the work station and/or another computer device of the system, etc.). An automated process control system can be utilized to help monitor and control operations of the boiler 1 and/or burner 5. Such a process control system can also facilitate implementation of an embodiment of using the boiler 1 and/or burner 5.

As yet another example, the coal transport fluid in which the coal particulates are entrained can be a suitable gas or mixture of gases that can entrain the coal particulates for feeding to the coal to the combustion chamber. The transport fluid can include an oxidant component or may not include any oxidant component. Examples of a transport fluid for entrainment of the coal particulates for use in the first flow 19*f* of a mixture of pulverized coal and transport fluid can include air, nitrogen, air mixed with nitrogen, carbon dioxide, oxygen enhanced air, air mixed with hydrogen gas, oxygen enriched air mixed with hydrogen gas, a flue gas including combustion products, or other suitable gas flow that can include a mixture of gases or a single gas. Examples of a transport fluid for entrainment of the coal particulates for use in the second flow of a mixture of pulverized coal and a transport fluid can include air, nitrogen, air mixed with nitrogen, carbon dioxide, oxygen enhanced air, air mixed with hydrogen gas, oxygen enriched air mixed with hydrogen gas, a flue gas including combustion products, or other suitable gas flow that can include a mixture of gases or a single gas.

It should be appreciated that modifications to the embodiments explicitly shown and discussed herein can be made to meet a particular set of design objectives or a particular set of design criteria. For example, embodiments of the burner 5 can utilize other suitable pre-selected flow rates or a flow rate within a pre-selected feed flow rate range for flows of oxidants, hydrogen, and pulverized coal to meet a particular set of design criteria. As another example, the distances for the first, second, and third distances d1, d2, and d3 and/or the values of one or more radiuses (e.g., radius r1, radius r2, radius r3, radius r4, etc.), or other sizing parameter discussed herein can be different values to account for combustion chamber sizing, desired flow rates, type of coal feed, and other design considerations for meeting a particular set of design criteria.

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of boilers, combustors, burners, processes for operating burners, processes for operating boilers and/or combustors, and methods of making and using the same have been shown and described above, it is to be distinctly understood that the invention is not limited thereto but may be otherwise variously embodied and practiced within the scope of the following claims.

What is claimed is:

1. A burner for a combustion chamber comprising:

a first pulverized coal entrained fluid flow conduit;

an inner hydrogen conduit; and a hydrogen oxidant conduit positioned between the first pulverized coal entrained fluid flow conduit and the inner hydrogen conduit;

an outlet of the inner hydrogen conduit positioned a first distance from an outlet of the hydrogen oxidant conduit such that hydrogen output from the outlet of the inner hydrogen conduit passes through a portion of the hydrogen oxidant conduit to the outlet of the hydrogen oxidant conduit;

the outlet of the hydrogen oxidant conduit being a second distance from an outlet of the first pulverized coal entrained fluid flow conduit such that the hydrogen and the hydrogen oxidant output from the outlet of the hydrogen oxidant conduit passes through a portion of the first pulverized coal entrained fluid flow conduit for being output from the burner;

a mixing conduit positioned in the portion of the first pulverized coal entrained fluid flow conduit through which the hydrogen and the hydrogen oxidant output from the outlet of the hydrogen oxidant conduit passes for being output from the burner, an inlet of the mixing conduit being spaced apart from the outlet of the hydrogen oxidant conduit by a gap having a gap distance;

a splitter positioned to encircle an outer peripheral portion of an outlet region of the hydrogen oxidant flow conduit in the first pulverized coal entrained fluid flow conduit to split the first pulverized coal entrained fluid flow into a first inner flow portion that is directed to the inlet of the mixing conduit to pass through the mixing conduit and a second outer flow portion that passes along an outer side of the mixing conduit;

the outlet of the inner hydrogen conduit being an axial length $L_{H2}$ away from the outlet of the hydrogen oxidant conduit, the inner hydrogen conduit also having a diameter $D_{H2}$;

the inlet of the mixing conduit being the gap distance from the outlet of the hydrogen oxidant conduit; and wherein:

$$1 \leq L_{H2}/D_{H2} \leq 5 \text{and} \quad \text{(i)}$$

$$0.05 \leq ((r_6^2 - r_5^2)/(r_8^2 - r_7^2)) \leq 0.25; \quad \text{(ii)}$$

where $r_5$ is an outer radius of the hydrogen conduit, $r_6$ is an inner radius of the splitter, $r_7$ is an outer radius of the splitter and $r_8$ is an inner radius of the first pulverized coal entrained fluid flow conduit.

2. The burner of claim 1, wherein the first pulverized coal entrained fluid flow conduit comprises an annular conduit and the hydrogen oxidant conduit comprises an annular conduit.

3. The burner of claim 2, comprising:

a secondary oxidant conduit positioned adjacent an outer periphery of the first pulverized coal entrained fluid flow conduit to pass a flow of secondary oxidant through the burner and into the combustion chamber, at least one swirler positioned in the secondary oxidant conduit so the flow of secondary oxidant swirls within the combustion chamber.

4. The burner of claim 2, comprising:

a second pulverized coal entrained fluid flow conduit positioned adjacent an outer periphery of the first pulverized coal entrained fluid flow conduit such that the first pulverized coal entrained fluid flow conduit is between the second pulverized coal entrained fluid flow conduit and the hydrogen oxidant conduit; and a secondary oxidant conduit positioned adjacent an outer periphery of the second pulverized coal entrained fluid flow conduit to pass a flow of secondary oxidant through the burner and into the combustion chamber.

5. The burner of claim 1, wherein the outlet of the hydrogen oxidant conduit is a tapered outlet having a tapered portion and there is gap defined between the outlet of the hydrogen oxidant conduit and the mixing conduit such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit.

6. The burner of claim 1, wherein the outlet of the hydrogen oxidant conduit is an enlarged outlet having an enlarged portion and there is a gap defined between the outlet of the hydrogen oxidant conduit and the mixing conduit such that a first portion of pulverized coal passed through the first pulverized coal entrained fluid flow conduit is passed through the gap to be mixed with the hydrogen and the hydrogen oxidant output from the outlet of the hydrogen oxidant conduit within the mixing conduit while a second portion of the pulverized coal passed through the first pulverized coal entrained fluid flow conduit passes along an outer side of the mixing conduit.

7. The burner of claim 1, wherein the first pulverized coal entrained fluid flow conduit is positioned to receive a flow of pulverized coal entrained within a fluid that comprises hydrogen.

8. The burner of claim 1, comprising:

a secondary oxidant conduit positioned adjacent an outer periphery of the first pulverized coal entrained fluid flow conduit to pass a flow of secondary oxidant through the burner and into the combustion chamber;

the inlet of the mixing conduit being an inlet distance $G_c$ from a tapering location of the outlet of the hydrogen oxidant conduit at which the hydrogen oxidant conduit starts to taper to the outlet of the hydrogen oxidant conduit; and wherein:

$$0.05 \leq ((2*G_c*r_1)/(r_4^2-r_1^2)) \leq 0.15;$$

where $r_1$ is a radius of the inner hydrogen conduit, $r_2$ is a radius of the hydrogen oxidant conduit, $r_3$ is a radius of the first pulverized coal entrained fluid flow conduit and $r_4$ is a radius of the secondary oxidant conduit.

9. The burner of claim 8, wherein the inlet distance $G_c$ is an axial length of a gap between the inlet of the mixing conduit and the tapering location of the hydrogen oxidant conduit.

10. The burner of claim 1, comprising:

a secondary oxidant conduit positioned adjacent an outer periphery of the first pulverized coal entrained fluid flow conduit to pass a flow of secondary oxidant through the burner and into the combustion chamber; and the outlet of the inner hydrogen conduit being an axial distance $X_{H2}$ relative to the outlet of the hydrogen oxidant conduit;

wherein:

$$-1 \leq X_{H2}/D_{H2} \leq 5 \text{and/or} \quad \text{(i)}$$

$$0.05 \leq ((2*dg*r_1)/(r_4^2-r_1^2)) \leq 0.15; \quad \text{(ii)}$$

where dg is the gap distance, $r_1$ is a radius of the inner hydrogen conduit, $r_2$ is a radius of the hydrogen oxidant conduit, $r_3$ is a radius of the first pulverized coal entrained fluid flow conduit and $r_4$ is a radius of the secondary oxidant conduit.

11. The burner of claim 10, wherein the gap distance is an axial distance between the outlet of the hydrogen oxidant conduit and the inlet of the mixing conduit.

12. The burner of claim 1, wherein the splitter is positioned between the first pulverized coal entrained fluid flow conduit and the hydrogen oxidant conduit adjacent to the outlet of the hydrogen oxidant conduit to divert the first inner flow portion along a passageway defined between the splitter and the hydrogen oxidant conduit for mixing pulverized coal of the first inner portion with the hydrogen and the hydrogen oxidant output from the outlet of the hydrogen oxidant conduit within the mixing conduit.

13. A boiler comprising:

at least one burner positioned to generate at least one flame within a combustion chamber, the at least one burner comprising a first burner, the first burner being the burner of claim 1.

14. The boiler of claim 13, also comprising:

a source of pulverized coal connected to an inlet of the first pulverized coal entrained fluid flow conduit;

a source of hydrogen connected to an inlet of the inner hydrogen conduit; and a source of a flow of an oxidant connected to an inlet of the hydrogen oxidant conduit.

15. The boiler of claim 13, comprising:

a source of hydrogen positioned for injection of hydrogen into a flow of pulverized coal entrained within a fluid, and wherein the first pulverized coal entrained fluid flow conduit is positioned to receive the flow of pulverized coal entrained within the fluid, the fluid comprising an oxidant and the hydrogen from the source of the hydrogen.

16. A method for generating a flame in a combustion chamber of a combustion device, comprising:

feeding hydrogen, a hydrogen oxidant flow, and a first pulverized coal entrained in an oxidant flow to a burner such that the hydrogen is passed through an inner hydrogen conduit of the burner, the hydrogen oxidant flow is passed through a hydrogen oxidant conduit of the burner that is positioned between a first pulverized coal entrained fluid flow conduit and the inner hydrogen conduit, and the first pulverized coal entrained in the oxidant flow is passed through the first pulverized coal entrained fluid flow conduit;

outputting the hydrogen from an outlet of the inner hydrogen conduit so the hydrogen passes a first distance as the hydrogen passes from the outlet of the inner hydrogen conduit to an outlet of the hydrogen oxidant conduit such that hydrogen output from the outlet of the inner hydrogen conduit passes through a portion of the hydrogen oxidant conduit to the outlet of the hydrogen oxidant conduit; and outputting the hydrogen and the hydrogen oxidant flow out of the outlet of the hydrogen oxidant conduit so the hydrogen and the hydrogen oxidant flow passes a second distance as the hydrogen passes from the outlet of the hydrogen oxidant conduit to an outlet of the first pulverized coal entrained fluid flow conduit such that the hydrogen and the hydrogen oxidant output from the outlet of the hydrogen oxidant conduit passes through a portion of the first pulverized coal entrained fluid flow conduit for forming a pilot flame to emanate from an outlet of the burner;

splitting a first portion of the first pulverized coal entrained in the oxidant flow from a second portion of the first pulverized coal entrained in the oxidant flow in a splitter so the first portion of the first pulverized coal entrained in the oxidant flow mixes with the hydrogen and the hydrogen oxidant flow in a mixing conduit as the hydrogen and the hydrogen oxidant flow pass along the second distance within the burner to form the pilot flame while the second portion of the first pulverized coal entrained in the oxidant flow is passed through the first pulverized coal entrained fluid flow conduit to be output into the combustion chamber;

the outlet of the inner hydrogen conduit being an axial length $L_{H2}$ away from the outlet of the hydrogen oxidant conduit, the inner hydrogen conduit also having a diameter $D_{H2}$;

the inlet of the mixing conduit being the gap distance from the outlet of the hydrogen oxidant conduit; and wherein:

$$1 \leq L_{H2}/D_{H2} \leq 5 \text{and} \quad \text{(i)}$$

$$0.05 \leq ((r_6^2-r_5^2)/(r_8^2-r_7^2)) \leq 0.25; \quad \text{(ii)}$$

where $r_5$ is an outer radius of the hydrogen conduit, $r_6$ is an inner radius of the splitter, $r_7$ is an outer radius of the splitter and $r_8$ is an inner radius of the first pulverized coal entrained fluid flow conduit.

17. The method of claim 16, further comprising:

injecting hydrogen into the first pulverized coal entrained in the oxidant flow before the first pulverized coal entrained in the oxidant flow is fed to the burner such that the first pulverized coal entrained in the oxidant flow passed through the first pulverized coal entrained fluid flow conduit comprises hydrogen, pulverized coal, and an oxidant.

* * * * *